US012660957B2

(12) United States Patent
Cooper

(10) Patent No.: US 12,660,957 B2
(45) Date of Patent: Jun. 23, 2026

(54) CHRISTMAS TREE

(71) Applicant: Shawn Cooper, Baton Rouge, LA (US)

(72) Inventor: Shawn Cooper, Baton Rouge, LA (US)

(73) Assignee: ORNAMENTAL MOTIONS DESIGN AND CONSULTING CORPORATION, Baton Rouge, LA (US)

( * ) Notice: Subject to any disclaimer, the term of this patent is extended or adjusted under 35 U.S.C. 154(b) by 0 days.

(21) Appl. No.: 19/176,943

(22) Filed: Apr. 11, 2025

(65) Prior Publication Data

US 2026/0137227 A1 May 21, 2026

Related U.S. Application Data

(60) Provisional application No. 63/722,003, filed on Nov. 18, 2024, provisional application No. 63/722,009, filed on Nov. 18, 2024.

(51) Int. Cl.
*A47G 33/08* (2006.01)
*A47G 33/06* (2006.01)

(52) U.S. Cl.
CPC ..... *A47G 33/0809* (2013.01); *A47G 33/06* (2013.01); *A47G 2033/0827* (2013.01)

(58) Field of Classification Search
CPC ..... A47G 33/0809; A47G 33/06; A47G 2033/0827
See application file for complete search history.

(56) References Cited

U.S. PATENT DOCUMENTS 1,824,388 A * 9/1931 George ..... F04D 25/08 40/439
3,085,774 A 4/1963 Di Lenno
3,811,991 A 5/1974 Dieffenbach
4,130,678 A 12/1978 Higgins
4,734,301 A 3/1988 McKinney
D340,043 S 10/1993 Louis
5,336,536 A * 8/1994 Oberzan ..... F21S 4/10 428/9

(Continued)

FOREIGN PATENT DOCUMENTS

CN 201519026 U 7/2010
CN 102697370 B 10/2012

(Continued)

OTHER PUBLICATIONS https://www.wirefence.co.uk/chicken-wire-xmas-tree-diy/.

(Continued)

*Primary Examiner* — Evan P Dzierzynski
(74) *Attorney, Agent, or Firm* — Gallium Law; Wesley Schwie; Isabel Fox

(57) ABSTRACT

In some embodiments, an apparatus includes a base support, a structure extending from the base support, wherein the structure includes a substantially hollow interior portion and an outer surface located opposite the substantially hollow interior portion, and an air circulation device located within the substantially hollow interior portion of the structure. The apparatus may include a plurality of ornaments located on the outer surface of the structure, wherein the air circulation device may be configured to circulate air through the structure and onto the plurality of ornaments.

20 Claims, 21 Drawing Sheets

(56) References Cited

U.S. PATENT DOCUMENTS

| | | | | |
|---|---|---|---|---|
| 5,639,521 | A | 6/1997 | Fraus | |
| D430,062 | S | 8/2000 | Thomas | |
| D442,115 | S | 5/2001 | Tsang | |
| 6,306,471 | B1 | 10/2001 | Pitman | |
| 6,312,137 | B1 * | 11/2001 | Hsieh | G09F 3/00 362/294 |
| 6,334,694 | B1 * | 1/2002 | Huang | F21S 4/10 362/123 |
| 6,350,499 | B1 | 2/2002 | Babcock | |
| 6,454,441 | B1 * | 9/2002 | Lin | F21S 10/00 40/412 |
| 6,679,622 | B1 * | 1/2004 | Kao | A41G 1/005 362/567 |
| 6,764,195 | B1 | 7/2004 | Cutliff | |
| 6,936,314 | B1 | 8/2005 | Schultz | |
| 7,563,000 | B2 | 7/2009 | Gierveld | |
| 7,601,407 | B2 | 10/2009 | Irvine | |
| 8,789,972 | B2 | 7/2014 | Plumb | |
| 9,055,835 | B1 * | 6/2015 | Rahman | A47G 33/0845 |
| D778,771 | S | 2/2017 | Sallis | |
| D889,311 | S | 7/2020 | Cantoni | |
| D905,591 | S | 12/2020 | Tucker | |
| 11,592,149 | B1 | 2/2023 | Cushing | |
| 2004/0136181 | A1 * | 7/2004 | Harvey | A41G 1/005 362/249.19 |
| 2006/0246235 | A1 | 11/2006 | Lin | |
| 2007/0291470 | A1 * | 12/2007 | Thomson | F21S 10/04 362/96 |
| 2014/0233221 | A1 | 8/2014 | Tsai | |
| 2016/0150903 | A1 * | 6/2016 | Loos | F21V 33/0028 362/123 |
| 2020/0054160 | A1 | 2/2020 | Puleo | |
| 2020/0128994 | A1 * | 4/2020 | Ford | A47G 33/08 |
| 2023/0225537 | A1 | 7/2023 | Johnson | |

FOREIGN PATENT DOCUMENTS

| | | | |
|---|---|---|---|
| EP | 0 527 711 | A2 | 2/1993 |
| EP | 4410156 | A1 | 8/2024 |

OTHER PUBLICATIONS https://www.hometalk.com/diy/decorate/christman/yarn-ball-ornament-tree-24701352.
https://meatballandmontycat.wordpress.com/2015/12/12/how-to-make-a-christmas-tree-for-your-cat/.
https://familyfocusblog.com/chicken-wire-christmas-tree-tutorial/.

* cited by examiner

CHRISTMAS TREE

CROSS-REFERENCE TO RELATED APPLICATIONS

The present application claims priority to U.S. Provisional Patent Application No. 63/722,009, filed on Nov. 18, 2024, entitled REFLECTORIZING CHRISTMAS TREE WITH FRINGE the entire disclosure of which is incorporated by reference herein.

The present application claims priority to U.S. Provisional Patent Application No. 63/722,003, filed on Nov. 18, 2024, entitled REFLECTORIZING CHRISTMAS TREE WITH PINWHEELS the entire disclosure of which is incorporated by reference herein.

TECHNICAL FIELD

The invention is directed to an enhanced Christmas tree design that brings motion of ornaments and enhanced light movement to the tree with lights installed on the inside of the tree. The invention is designed to bring motion to ornaments while enhancing the reflection of light.

BACKGROUND

Decorated trees have been a traditional feature of the Christmas season since at least the $16^{th}$ century, and often featured ornaments of some type, ranging from candles to dried fruit, nuts, and popcorn. By the late $19^{th}$ century, Christmas trees were often decorated with other homemade ornaments more similar to those still used today. With the discovery of electricity came the popularization of Christmas lights as another way to decorate Christmas trees. Today, Christmas trees, both natural and artificial, remain a staple seasonal decoration for millions of people around the world.

SUMMARY OF THE INVENTION

The disclosure includes an apparatus including a base support, a structure extending from the base support, wherein the structure includes a substantially hollow interior portion and an outer surface located opposite the substantially hollow interior portion, and an air circulation device located within the substantially hollow interior portion of the structure. In some embodiments, the apparatus includes a plurality of ornaments located on the outer surface of the structure, wherein the air circulation device is configured to circulate air through the structure and onto the plurality of ornaments. The structure may define a substantially conical shape. In some embodiments, the apparatus includes a top portion of the structure located opposite the base support. The base support may define a substantially circular shape, and the top portion may define a pointed end.

In some embodiments, the structure includes a plurality of openings in the outer surface. The apparatus may include at least one ornament located on the outer surface of the structure. In some embodiments, the at least one ornament includes a fastening element configured to couple to an opening of the plurality of openings such that the fastening element at least partially extends through the outer surface of the structure into the substantially hollow interior portion. At least a portion of the at least one ornament may be located along the outer surface of the structure. In some embodiments, each opening of the plurality of openings is configured to facilitate circulation of air between the substantially hollow interior portion and the outer surface.

The structure may be made of a mesh material including a plurality of interlaced wires. In some embodiments, the structure includes a double layer of mesh material. In some embodiments, the mesh material includes poultry netting.

The apparatus may include a plurality of light emitting diodes (LEDs) configured to couple to the structure. In some embodiments, the plurality of LEDs is coupled to the structure along the substantially hollow interior portion. The plurality of LEDs may be configured to emit light from the substantially hollow interior portion through the outer surface of the structure and into an external environment.

In some embodiments, the plurality of ornaments is selected from the group consisting of a plurality of pinwheels, a plurality of baubles, fringe, and combinations thereof. The apparatus may include an upper accessory configured to couple to a top portion of the structure.

The disclosure includes an apparatus including a base support, and a conical structure extending from the base support to a pointed top end, wherein the conical structure includes a substantially hollow interior portion and an outer surface located opposite the substantially hollow interior portion. In some embodiments, the conical structure is made of a mesh material. The apparatus may include at least one ornament located on the outer surface of the conical structure and coupled to the mesh material. In some embodiments, the apparatus includes an air circulation device located within the substantially hollow interior portion of the conical structure, wherein the air circulation device is configured to circulate air through the conical structure and onto the at least one ornament.

The base support may include a flexible tube material configured to receive a bottom edge of the conical structure, and the bottom edge may be located opposite the pointed top end. In some embodiments, the apparatus includes a plurality of light emitting diodes (LEDs) coupled to the conical structure along at least one of the substantially hollow interior portion and the outer surface. The plurality of LEDs may be coupled to the conical structure along the substantially hollow interior portion, and the at least one ornament may be coupled to the conical structure along the outer surface.

The foregoing, and other features and advantages of the invention, will be apparent from the following, more particular description of the preferred embodiments of the invention, the accompanying drawings, and the claims.

BRIEF DESCRIPTION OF DRAWINGS

These and other features, aspects, and advantages are described below with reference to the drawings, which are intended to illustrate, but not to limit, the invention. In the drawings, like characters denote corresponding features consistently throughout similar embodiments.

DETAILED DESCRIPTION OF THE INVENTION

The invention disclosed herein centers around a Christmas tree structure with reflective ornaments, such as pinwheels, baubles, and/or fringe, and an appropriately sized fan to blow enough air to move the ornaments. The movement of the reflective ornaments then creates a diffused and specular reflection of light from inside the structure.

Figure 1:
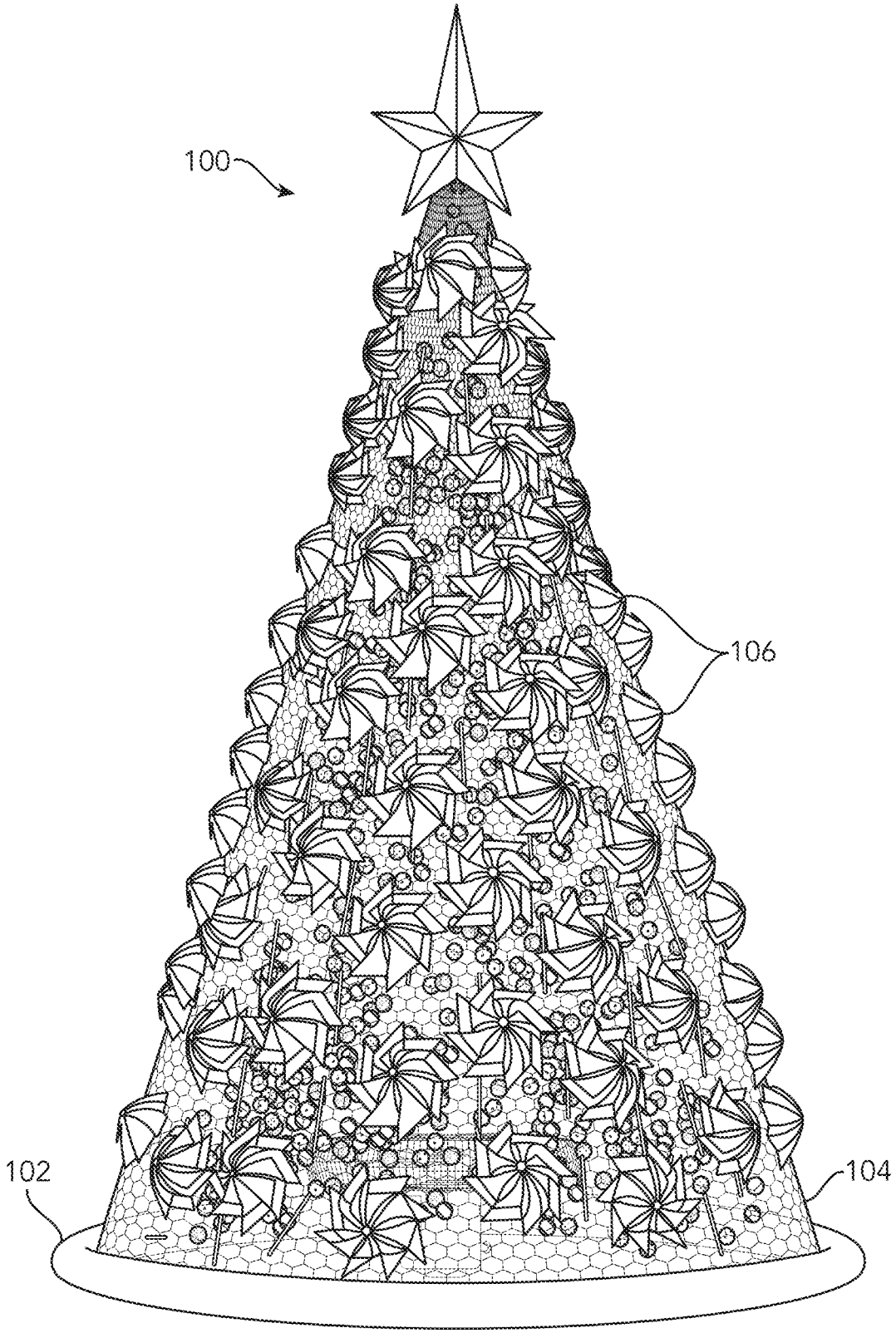
FIG. 1 illustrates a front view of the apparatus when decorated, according to some embodiments.

FIG. 1 shows a front view of an apparatus 100, which may include a base support 102 and a structure 104. In some embodiments, the structure 104 is coupled to and extends from, the base support 102. The base support 102 may be used to stabilize the structure 104 and prevent the structure 104 from tipping, sliding, or other unintentional movement. Further, the base support 102 may provide a barrier between the structure 104 and a ground surface to prevent damage to the structure and/or the ground surface. For example, when used indoors, the base support 102 may protect hardwood, tile, or carpeted floors from being scratched or scuffed by the structure 104. When used outdoors, the base support 102 may prevent the structure 104 from sinking into a soft ground surface or being damaged by a rough ground surface.

The apparatus 100 may also include a plurality of ornaments 106, as shown in FIG. 1. The plurality of ornaments 106 may be coupled to the structure 104, as will be discussed in greater detail later in this disclosure. It should be noted that FIG. 1 illustrates only one possible embodiment of the apparatus 100, and that the plurality of ornaments 106 may take a different form than that demonstrated in FIG. 1.

Figure 2:
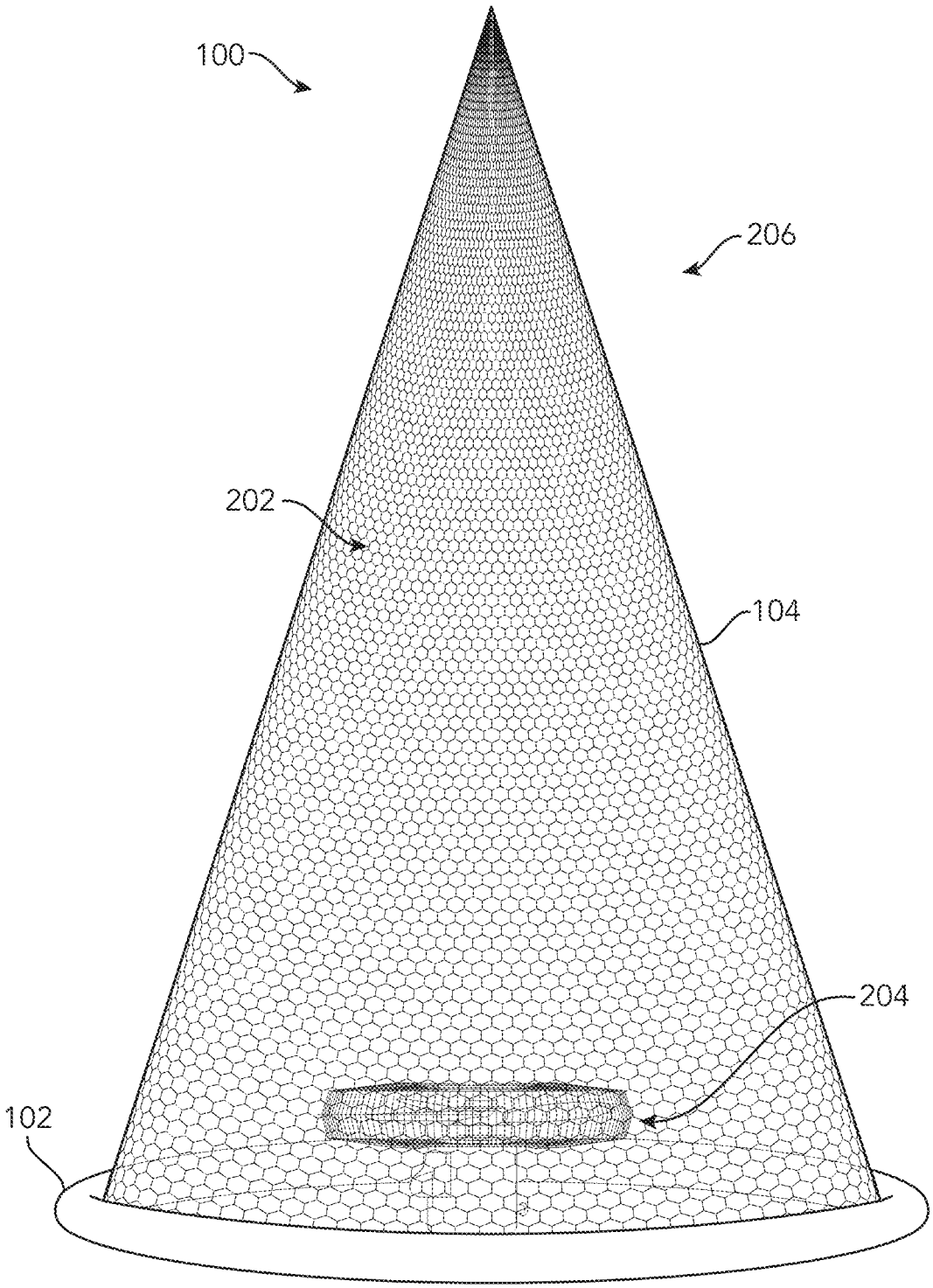
FIGS. 2 and 3 illustrate front views of the undecorated apparatus, according to some embodiments.

FIG. 2 shows the apparatus 100 without the plurality of ornaments 106. In some embodiments, the structure 104 includes an outer surface 202 and defines a substantially conical shape 206, as illustrated in FIG. 2. The substantially conical shape 206 may be designed to resemble the general shape of a traditional Christmas tree (e.g., fir, spruce, or pine tree varieties), with a wider base that tapers to a narrower top portion. In some embodiments, the plurality of ornaments 106 is coupled along the outer surface 202, as demonstrated in FIG. 1.

The apparatus 100 may also include an air circulation device 204, such as a fan, as shown in FIG. 2. In some embodiments, the air circulation device 204 is a floor fan appropriate for both indoor and outdoor use. The air circulation device 204 may be configured to operate while having a first side that is positioned substantially parallel with a ground surface, such that the airflow from the air circulation device 204 rises up through the structure 104. In some embodiments, the air circulation device 204 is configured to circulate air through the structure 104 and onto the plurality of ornaments 106, thereby causing the plurality of ornaments 106 to move. Movement of the plurality of ornaments 106 may include spinning, fluttering, oscillating, swaying, and/or any number of other types of movement, depending on the type of ornament of the plurality of ornaments 106.

In some embodiments, the apparatus 100 includes more than one air circulation device 204. For example, the apparatus 100 may include two, three, or more air circulation devices 204 positioned around a base portion of the structure 104. In an embodiment with multiple air circulation devices 204, each air circulation device 204 may be pointed in a different direction, as compared to at least one other air circulation device 204, to thereby maximize the airflow through and around the structure 104. The air circulation device(s) 204 may be located at different elevations (i.e., heights) within the structure 104, beyond what is specifically shown in the accompanying figures.

Figure 3:
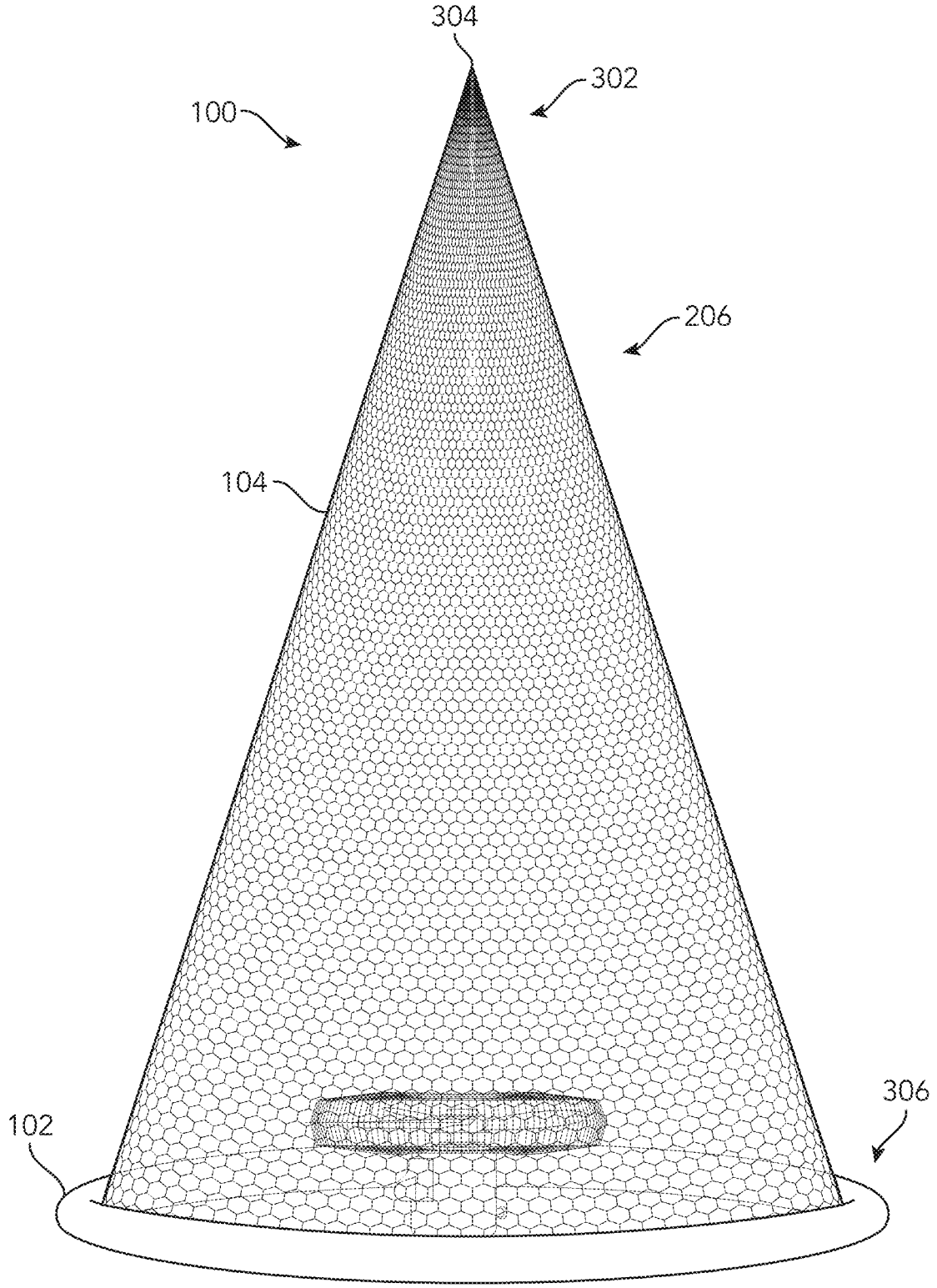

FIG. 3 illustrates another view of the apparatus 100 without the plurality of ornaments 106. In some embodiments, the apparatus 100 includes a top portion 302 of the structure 104 located opposite the base support 102. As demonstrated in FIG. 3, the top portion 302 may define a pointed end 304 and the base support 102 may define a substantially circular shape 306. In some embodiments, the substantially circular shape 306 of the base support 102 and the pointed end 304 of the top portion 302 contribute to the overall substantially conical shape 206 of the structure 104.

It should be noted that the structure 104 may define a shape other than substantially conical. For example, the structure 104 may define a pyramidical shape rather than a conical shape, where the base support 102 may define a substantially square or rectangular shape instead of the substantially circular shape 306. In an embodiment where the structure 104 defines a pyramidical shape, the top portion 302 may still define a pointed end 304. The structure 104 may also define a shape without a pointed top end, such as a column or cylinder. In some embodiments, the structure 104 defines a spherical or rounded shape, perhaps more reminiscent of a bush than a tree.

Figure 4:
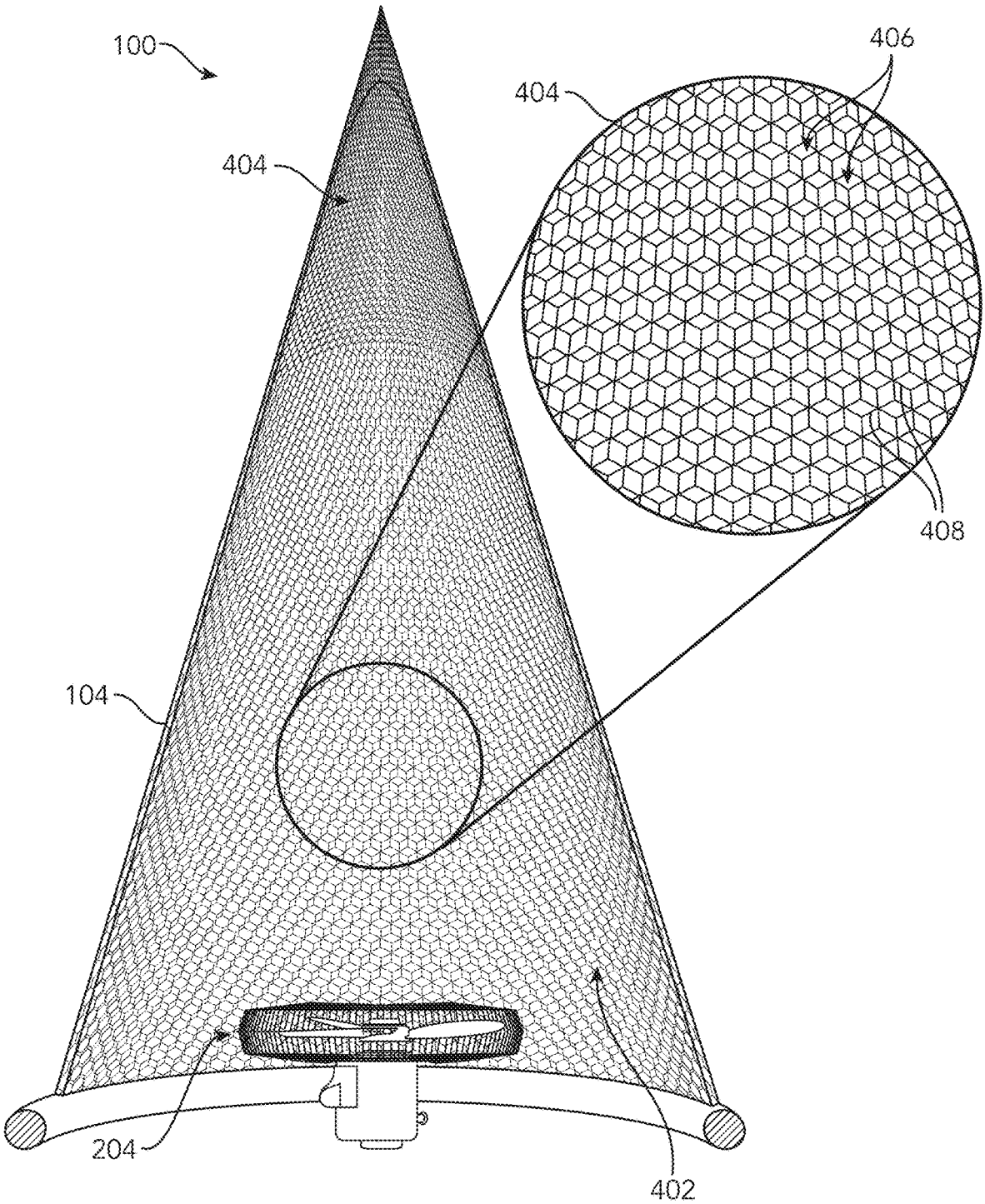
FIG. 4 illustrates a cross-sectional view of the apparatus with an inset view of the structure material, according to some embodiments.

FIG. 4 illustrates a cross-sectional view of the apparatus 100 and features an inset close-up view of a portion of the structure 104. In some embodiments, the structure 104 includes a substantially hollow interior portion 402, defined by an inner surface that is located opposite the outer surface 202. In some embodiments, the inner surface at least partially encloses the substantially hollow interior portion 402. The air circulation device 204 may be located within the substantially hollow interior portion 402, as demonstrated in FIG. 4. As previously discussed, the apparatus 100 may include more than one air circulation device 204. In an embodiment with multiple air circulation devices 204, each air circulation device 204 may be located within the substantially hollow interior portion 402 of the structure 104. At least one air circulation device 204 may be coupled to the structure 104 within the substantially hollow interior portion 402, such that at least one air circulation device 204 may be located at a different height than shown in FIG. 4. At least one air circulation device 204 may be located outside the structure 104, such as coupled to the outer surface 202 or located within an external environment adjacent to the structure 104.

Figure 5:
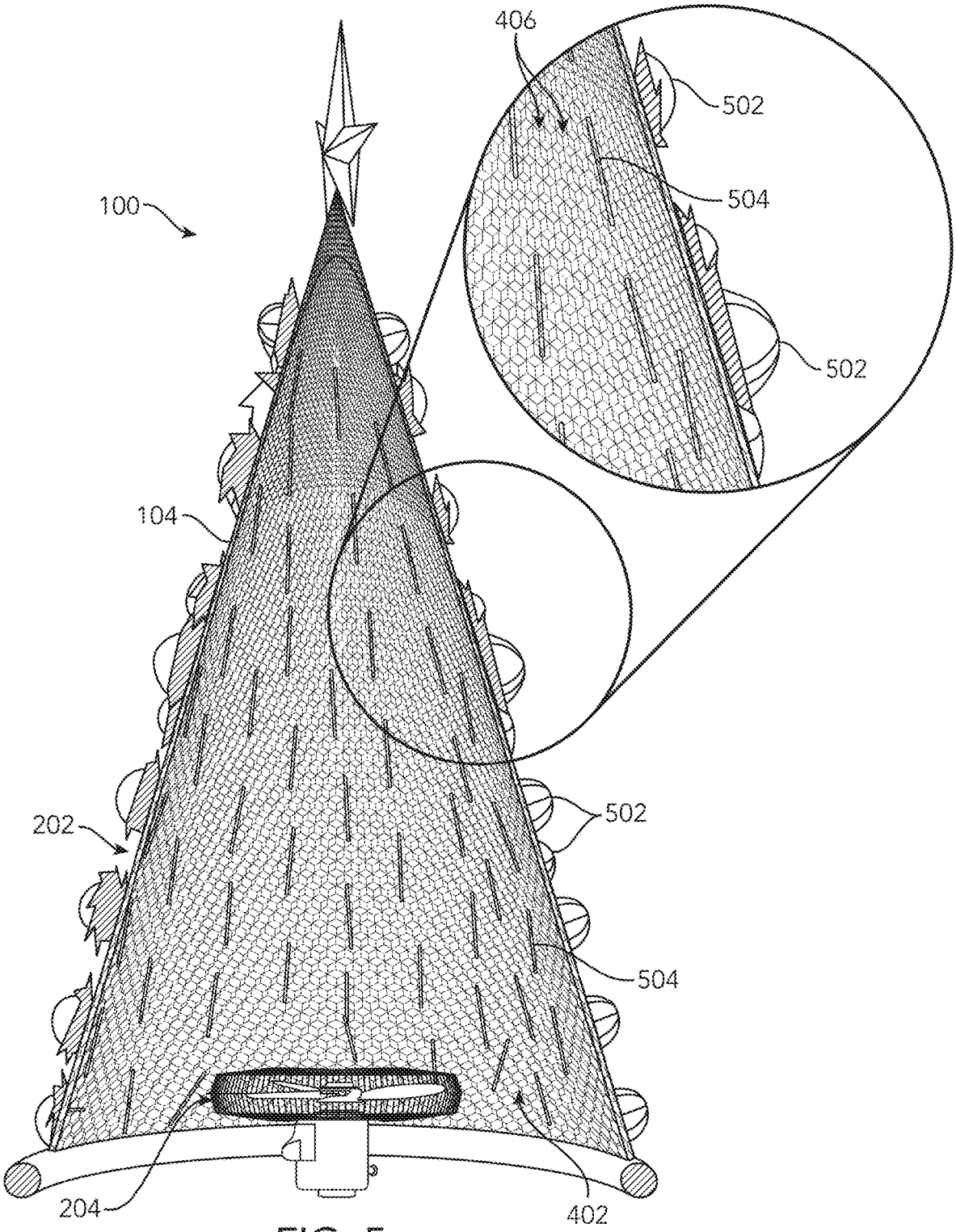
FIG. 5 illustrates a cross-sectional view of the apparatus with an inset view of the structure material and at least one ornament, according to some embodiments.
Figure 18:
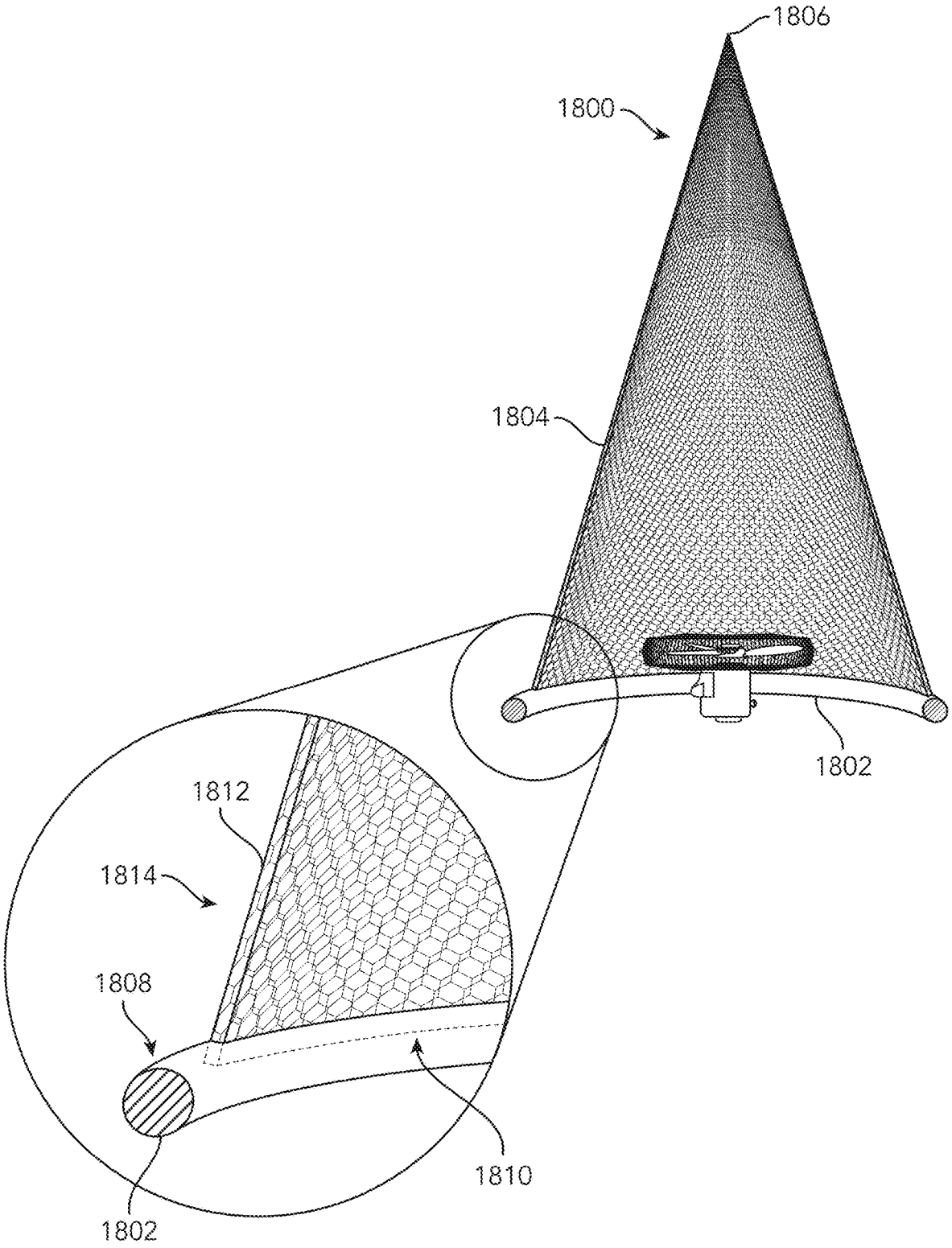
FIG. 18 illustrates a cross-sectional view of an apparatus with an inset view of the base support and the structure material, according to some embodiments.

In some embodiments, the structure 104 is made of a mesh material 404. The mesh material 404, and, therefore, the structure 104, may include a plurality of openings 406, as indicated in the insect view of FIG. 4. In some embodiments, the plurality of openings 406 enables the airflow from the air circulation device 204 to move from the substantially hollow interior portion 402 through the structure 104 and to the plurality of ornaments 106 located along the outer surface 202. The use of mesh material 404 to construct the structure 104 may also help the apparatus 100 be lightweight and easy for a user to move. In some embodiments, the mesh material 404 is made of a plurality of interlaced wires 408. The mesh material 404 may include a double layer of mesh material 404. In some embodiments, the layers of mesh material 404 are offset from one another, rather than aligned, to provide increased strength and support to the structure 104. It should be noted that for the sake of clarity in the accompanying figures, most of the figures show the layers of mesh material 404 aligned with one another. FIGS. 4, 5, and 18 show the layers of mesh material 404 offset from one another in a staggered configuration.

FIG. 5 shows a similar view as FIG. 4, but with at least one ornament 502 coupled to the structure 104. It should be noted that the at least one ornament 502 may be substantially the same as the plurality of ornaments 106 shown in FIG. 1; however, in some embodiments, the apparatus 100 includes only a single ornament of the at least one ornament 502, rather than the multiple ornaments of the plurality of ornaments 106.

Each ornament of the at least one ornament 502 may include a fastening element 504, as illustrated in FIG. 5. In some embodiments, the fastening element 504 is configured to couple to an opening of the plurality of openings 406 to thereby couple the at least one ornament 502 to the structure 104. The fastening element 504 may be configured to at least partially extend through the outer surface 202 of the structure 104 and into the substantially hollow interior portion 402, via an opening of the plurality of openings 406. Stated differently, the fastening element 504 may be received by, or receivably coupled to, an opening of the plurality of openings 406.

In some embodiments, the fastening element 504 includes a stick-like projection, as illustrated in FIG. 5. The fastening element 504 may include other types of fasteners, including, but not limited to, clip(s), hook and loop fastener(s), magnetic fastener(s), friction fit fastener(s), snap fastener(s), adhesive fastener(s), mechanical fastener(s), rope, and metal or similar tie fastener(s). In some embodiments, the fastening element 504 is a component of the at least one ornament 502. For example, the stick-like projection shown in FIG. 5 may be a handle of the pinwheel-style ornament of FIG. 5, and therefore part of the ornament itself. In some embodiments, the fastening element 504 is a separate component used to couple the at least one ornament 502 to the structure 104. For example, a wire hook, similar to a typical ornament hanger used to hang ornaments from a traditional Christmas tree, may be considered a fastening element 504 that is a separate component from the at least one ornament 502.

Figure 6:
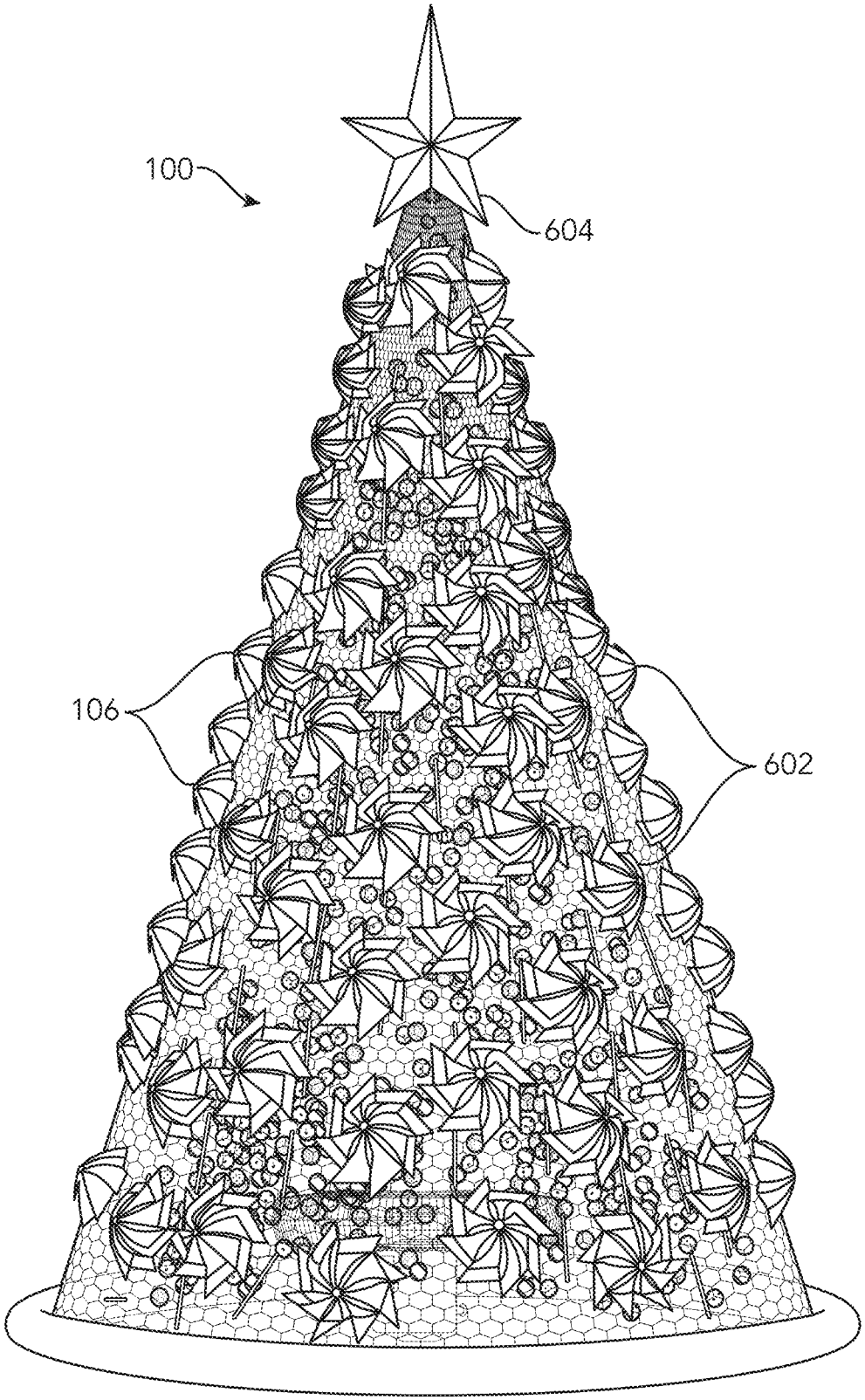
FIG. 6 illustrates a front view of the apparatus decorated with a plurality of pinwheels, according to some embodiments.
Figure 7:
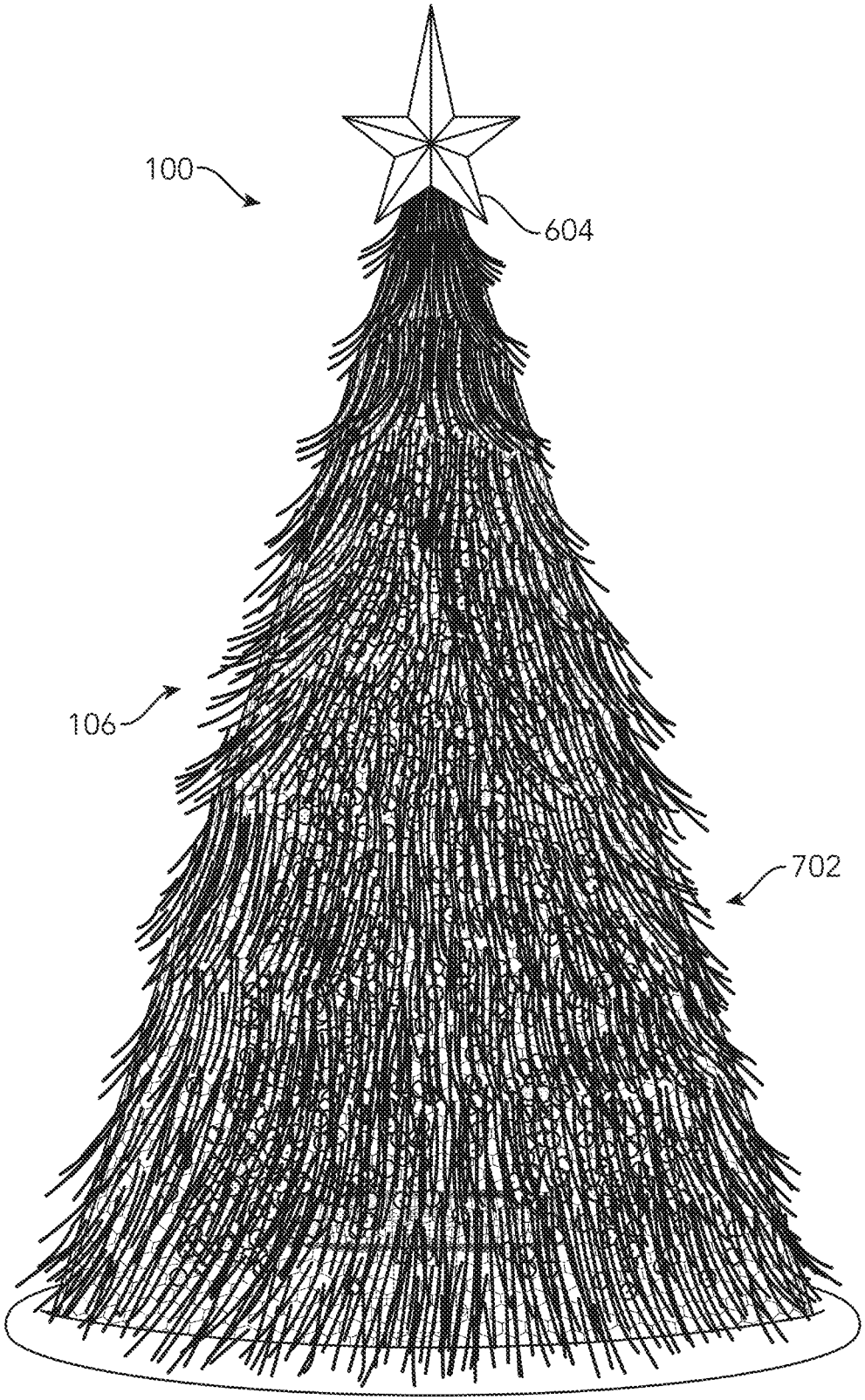
FIG. 7 illustrates a front view of the apparatus decorated with fringe, according to some embodiments.
Figure 8:
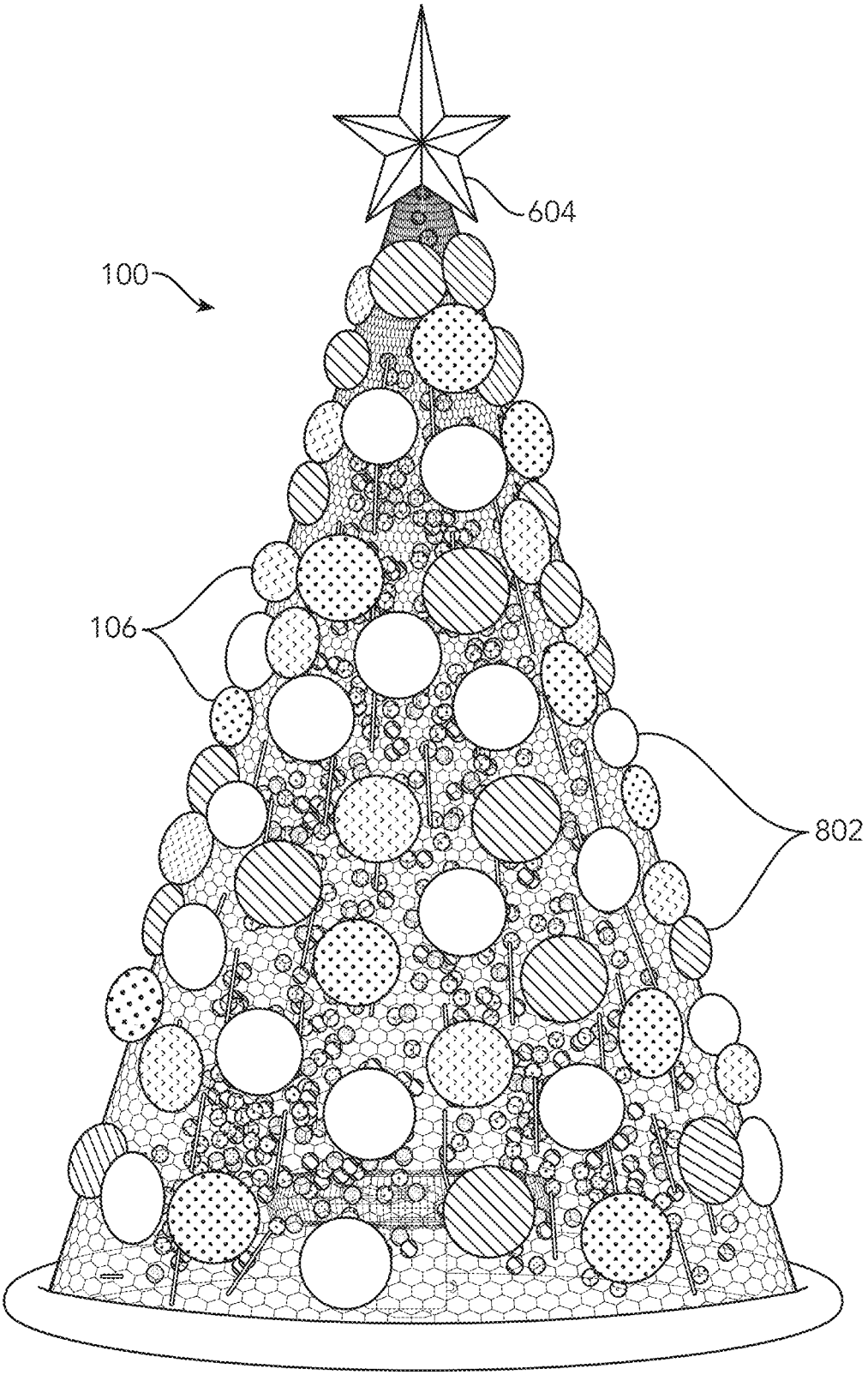
FIG. 8 illustrates a front view of the apparatus decorated with a plurality of baubles, according to some embodiments.

FIGS. 6, 7, and 8 illustrate the apparatus 100 with different types of ornaments representing the plurality of ornaments 106. FIGS. 6, 7, and 8 also show that the apparatus 100 may include an upper accessory 604, such as a star, configured to couple to a top portion 302 of the structure 104. The upper accessory 604 may include a different type of accessory or ornament, such as an angel or a bow, rather than the star shown throughout the figures. In addition, the plurality of ornaments 106 is not limited to the specific types of ornaments shown in FIGS. 6, 7, and 8. The ornaments shown in FIGS. 6, 7, and 8 are included as non-limiting examples.

In some embodiments, as shown in FIG. 6, the plurality of ornaments 106 includes a plurality of pinwheels 602. The plurality of pinwheels 602 may be configured to spin when air from the air circulation device 204 moves through the structure 104. In some embodiments, the plurality of pinwheels 602 is made of reflective material that shimmers as each pinwheel spins. In addition, the plurality of pinwheels 602 may be decorated with a design enhanced by spinning, such as a spiral.

In some embodiments, as shown in FIG. 7, the plurality of ornaments 106 includes fringe 702. The fringe 702 may be configured to flutter or shake when air from the air circulation device 204 moves through the structure 104. In some embodiments, the fringe 702 is made of a reflective material that shimmers as the fringe 702 flutters. The fringe 702 may be made of metallic material or non-metallic material, and may be available in any number of colors, including green, to most closely resemble a tree.

In some embodiments, as shown in FIG. 8, the plurality of ornaments 106 includes a plurality of baubles 802. The plurality of baubles 802 may include several different types of ornaments, including, but not limited to, spherical ornaments, flat circular ornaments, models or figurines, photographs, candles, ribbons, bows, and the like. The plurality of baubles 802 may be professionally produced or homemade and may be made of any number or combination of materials including, but not limited to, glass, plastic, paper, metallic, wood, and ceramic. Depending on the type of material, the plurality of baubles 802 may be configured to move when air from the air circulation device 204 moves through the structure 104. In some embodiments, the plurality of baubles 802 includes reflective material and is configured to shimmer when moved by the air from the air circulation device 204.

Figure 9:
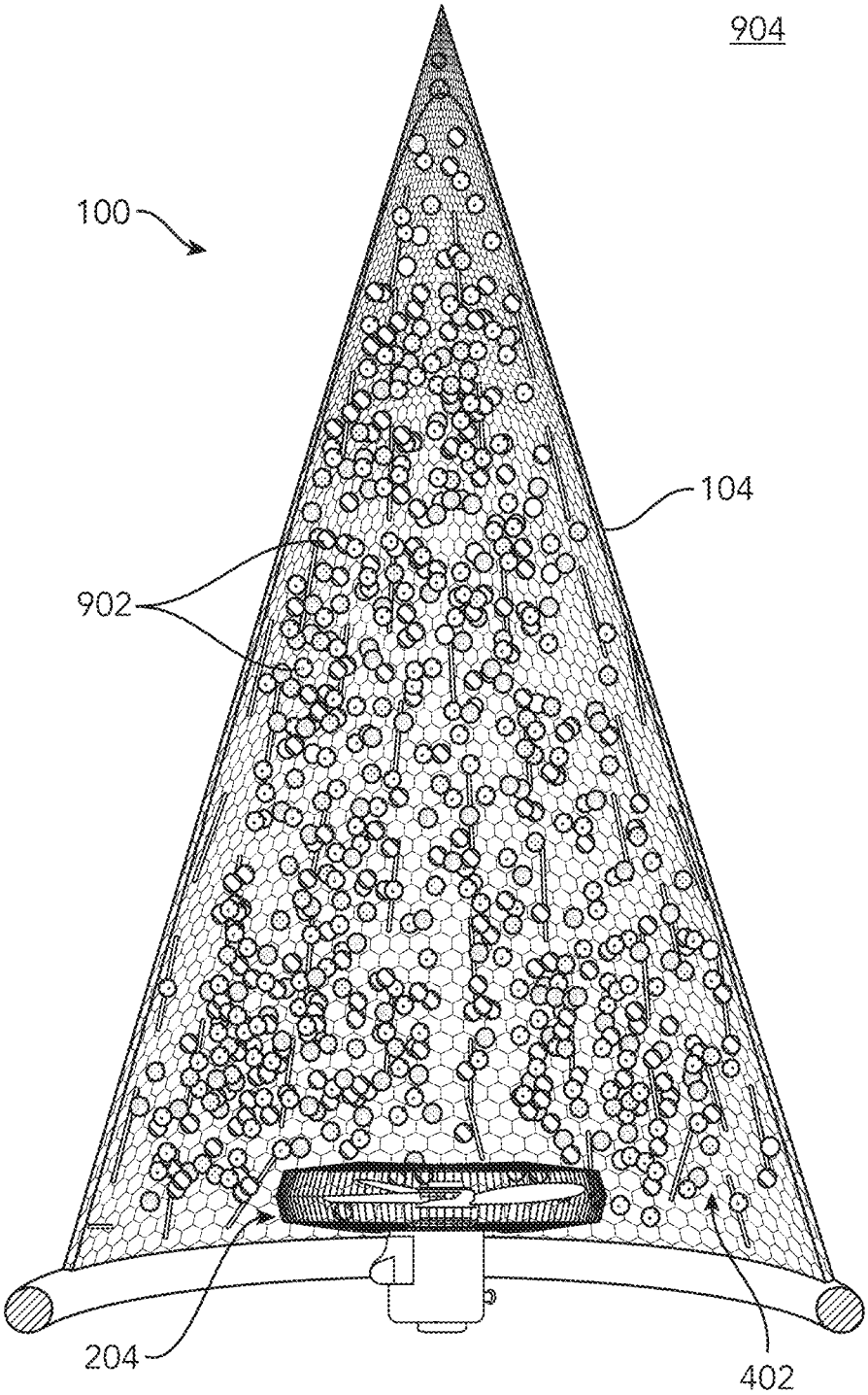
FIG. 9 illustrates a cross-sectional view of the apparatus including a plurality of LEDs, according to some embodiments.

FIG. 9 shows another cross-sectional view of the apparatus 100 featuring the substantially hollow interior portion 402. In some embodiments, the apparatus 100 includes a plurality of LEDs 902 coupled to the structure 104. The plurality of LEDs 902 may be coupled to the structure 104 along an inner surface of the substantially hollow interior portion 402. In some embodiments, the plurality of LEDs 902 includes one or more strands of LEDs similar to traditional decorative lights used around Christmas and other holidays. The plurality of LEDs 902 may be mechanically coupled to the substantially hollow interior portion 402, for example, by using wire ties to secure the plurality of LEDs 902 to the structure 104. The plurality of LEDs 902 may be arranged in a spiral configuration within the structure 104. The plurality of LEDs 902 may include individual lights, rather than one or more strands of connected lights. Each individual light of the plurality of LEDs 902 may be independently coupled to the structure 104.

In some embodiments, the plurality of LEDs 902 is configured to emit light from the substantially hollow interior portion 402 through the outer surface 202 of the structure 104 and into an external environment 904. When the plurality of ornaments 106 is coupled to the structure 104, the light emitted by the plurality of LEDs 902 may also be configured to reflect off the plurality of ornaments 106. For example, when the fringe 702 of FIG. 7 is coupled to the structure 104, the light emitted by the plurality of LEDs 902 may cause the fringe 702 to shimmer, especially when combined with airflow from the air circulation device 204. The airflow from the air circulation device 204 may also cause movement of the plurality of lights 902, and further impact the appearance of the apparatus 100. In some embodiments, the plurality of LEDs 902 is configured to emit light in a number of patterns, including, but not limited to, the following: solid emission, flashing, blinking, fading, twinkling, motion-activated, synchronized to music, and/or the like. The plurality of LEDs 902 may be configured to emit light in a single color or a combination of colors.

Figure 10:
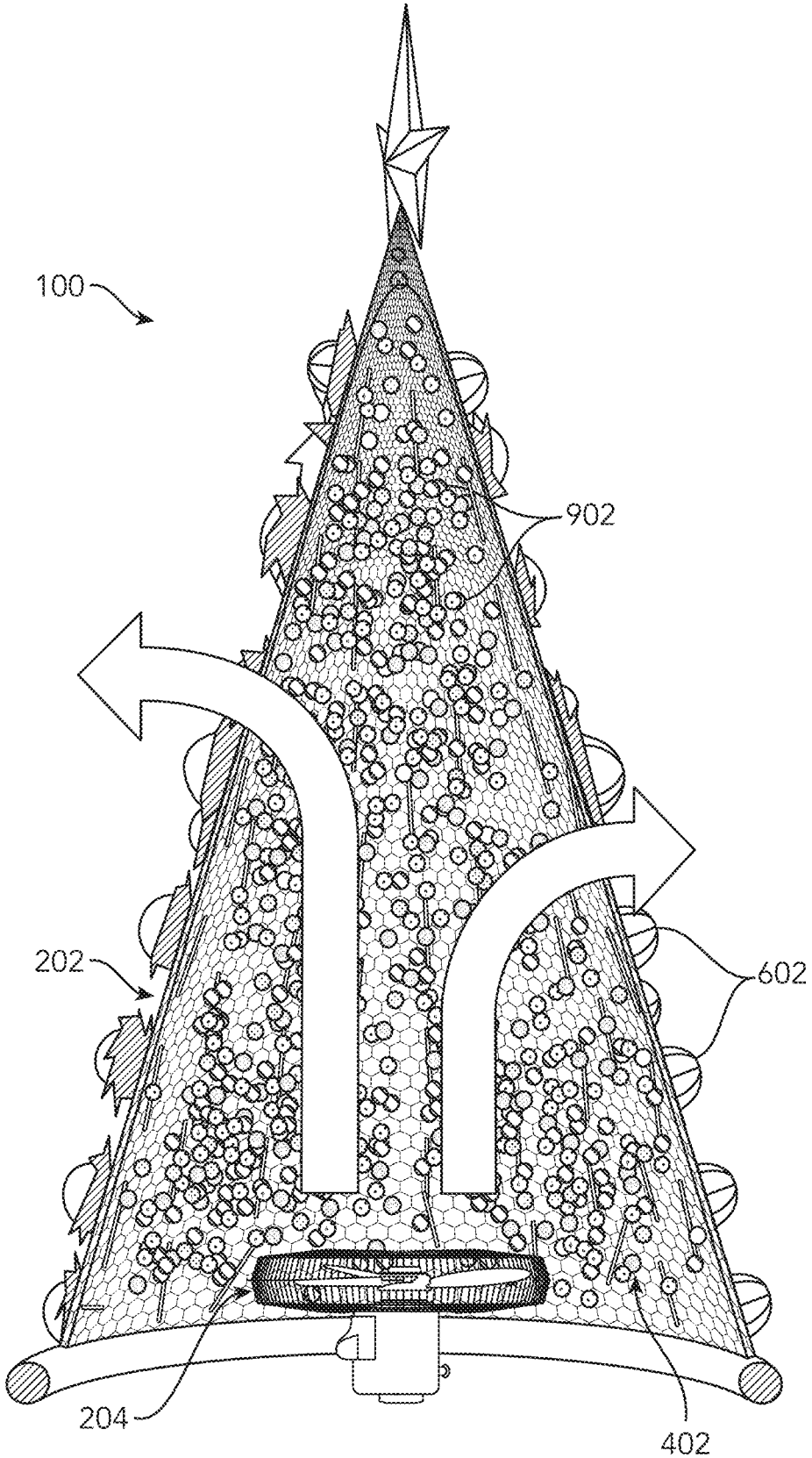
FIGS. 10 and 11 illustrate cross-sectional views of the apparatus with arrows indicating air flow through the structure, according to some embodiments.
Figure 11:
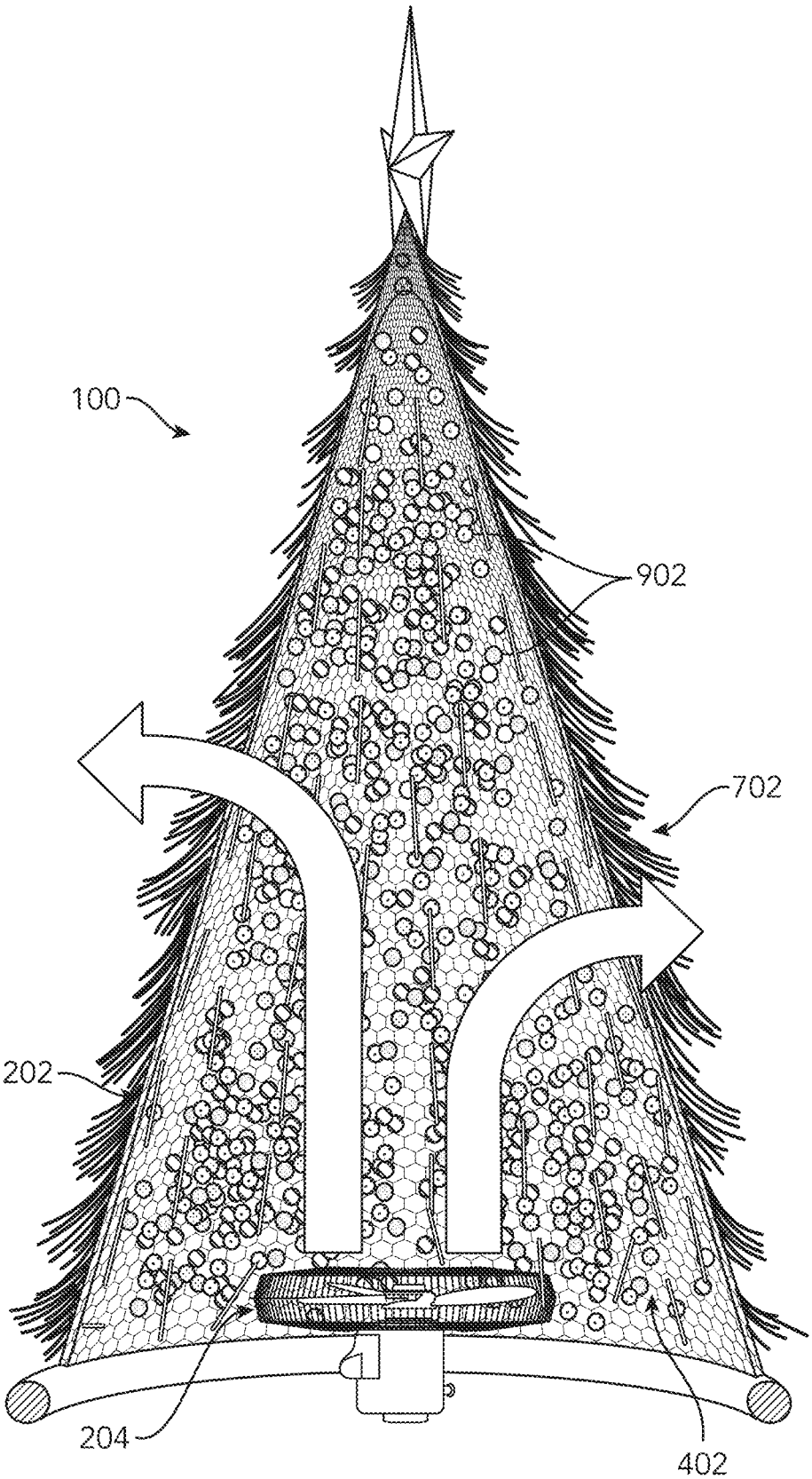

FIGS. 10 and 11 show cross-sectional views of the apparatus 100. FIG. 10 illustrates the apparatus 100 with a plurality of pinwheels 602 coupled to the outer surface 202, as previously shown in FIG. 6. FIG. 11 illustrates the apparatus 100 with fringe 702, as previously shown in FIG. 7. Both FIGS. 10 and 11 include large block arrows indicating the direction of airflow from the air circulation device 204. In some embodiments, the air from the air circulation device 204 is configured to flow up through the substantially hollow interior portion 402, across the plurality of LEDs 902, through the outer surface 202, and onto the plurality of pinwheels 602 (FIG. 10), the fringe 702 (FIG. 11), and/or any other type of ornament coupled to the outer surface 202. It should be noted that the airflow from the air circulation device 204 is not limited to the exact paths indicated by the block arrows in FIGS. 10 and 11. The arrows are intended as nonlimiting examples of airflow paths.

Figure 12:
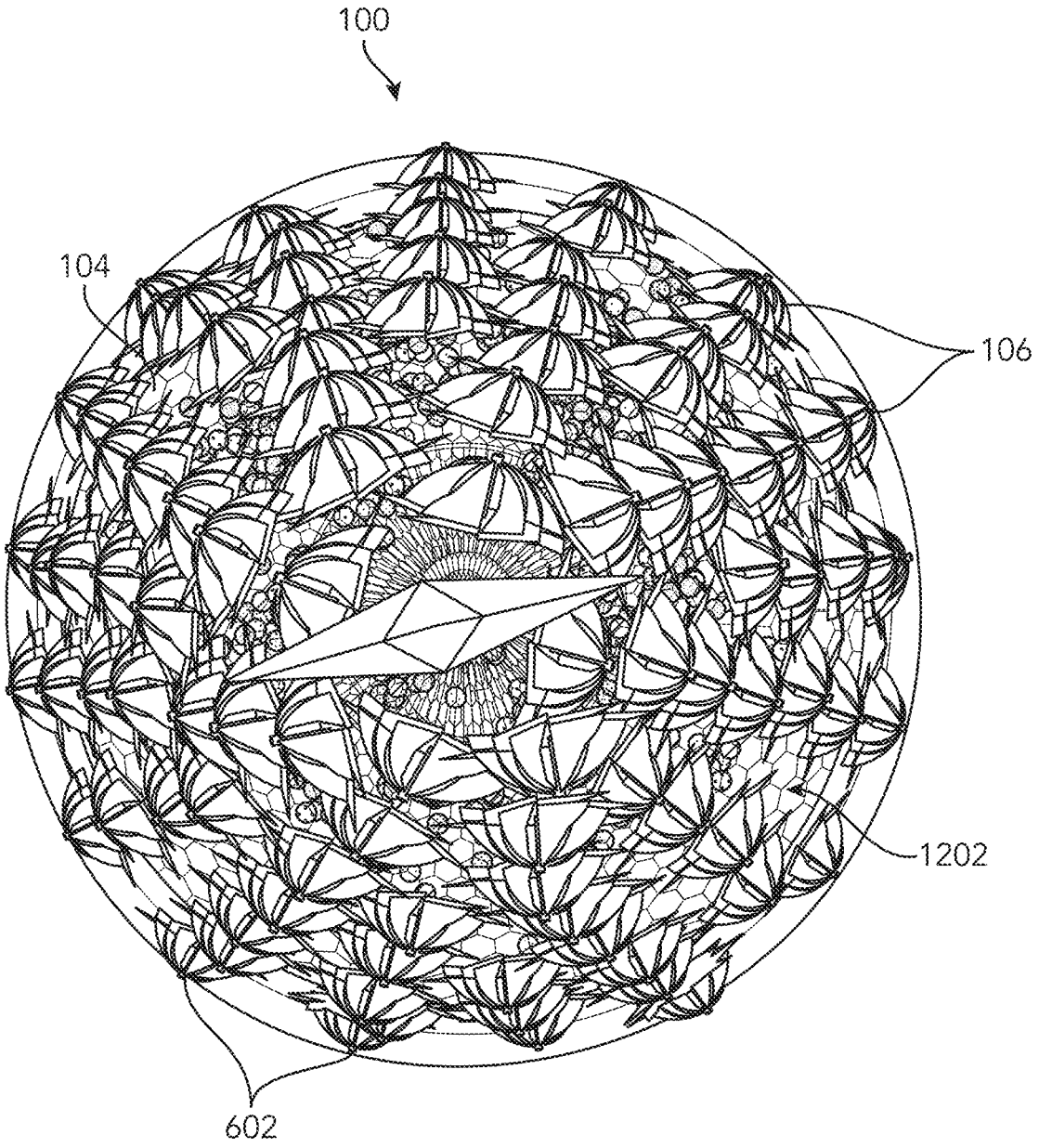
FIGS. 12 and 13 illustrate top-down views of the apparatus, according to some embodiments.
Figure 13:
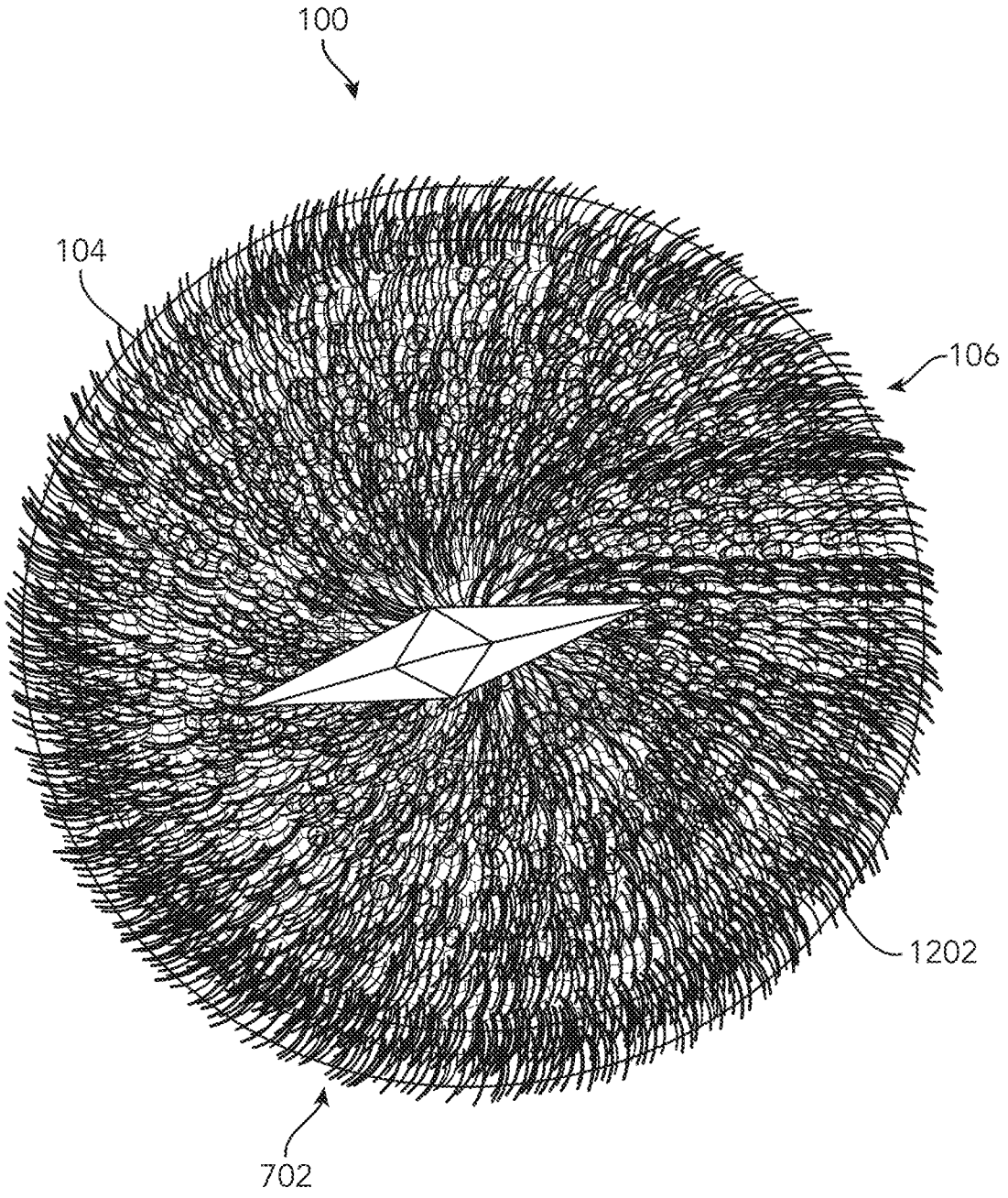

FIGS. 12 and 13 show top-down views of the apparatus 100. In some embodiments, the plurality of ornaments 106 is configured to cover substantially an entire surface area 1202 (e.g., the surface area of the outer surface 202) of the structure 104. The plurality of ornaments 106 may be configured to cover most, or a majority, of the surface area 1202. In some embodiments, the plurality of ornaments 106 is configured to cover at least half of the surface area 1202. The plurality of ornaments 106 may be configured to cover less than half of the surface area 1202. In some embodiments, the plurality of ornaments 106 is randomly distributed over the surface area 1202 by the user of the apparatus 100. When the plurality of ornaments 106 includes fringe 702, as shown in FIG. 13, the fringe 702 may be layered around the structure 104 in any manner desired by the user.

Figure 14:
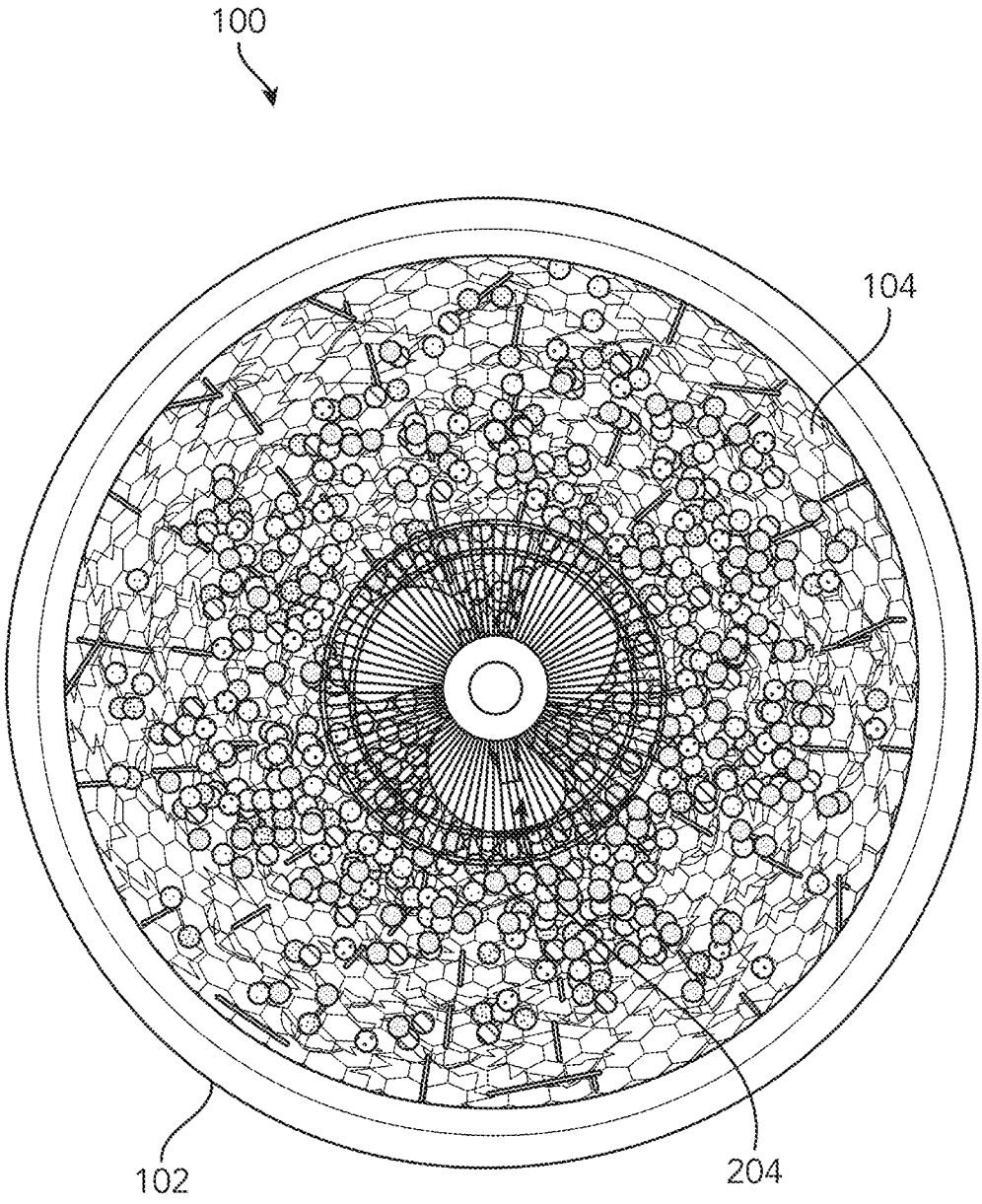
FIG. 14 illustrates a bottom-up view of the apparatus, according to some embodiments.

FIG. 14 illustrates a bottom-up view of the apparatus 100, including the air circulation device 204. As demonstrated in FIG. 14, the air circulation device 204 may be located substantially in the center of the base support 102 of the structure 104. In some embodiments, the air circulation device 204 is offset from the center. In an embodiment with more than one air circulation device 204, the apparatus 100 may include one air circulation device 204 in the center and one or more air circulation devices 204 offset from the center. In an embodiment with more than one air circulation device 204, each air circulation device 204 may be offset from the center. In some embodiments, the apparatus 100 includes a power source or link to a power source, such as an extension cord or surge protector, within the substantially hollow interior portion 402 to provide power to at least one of the air circulation device 204 and the plurality of LEDs 902.

Figure 15:
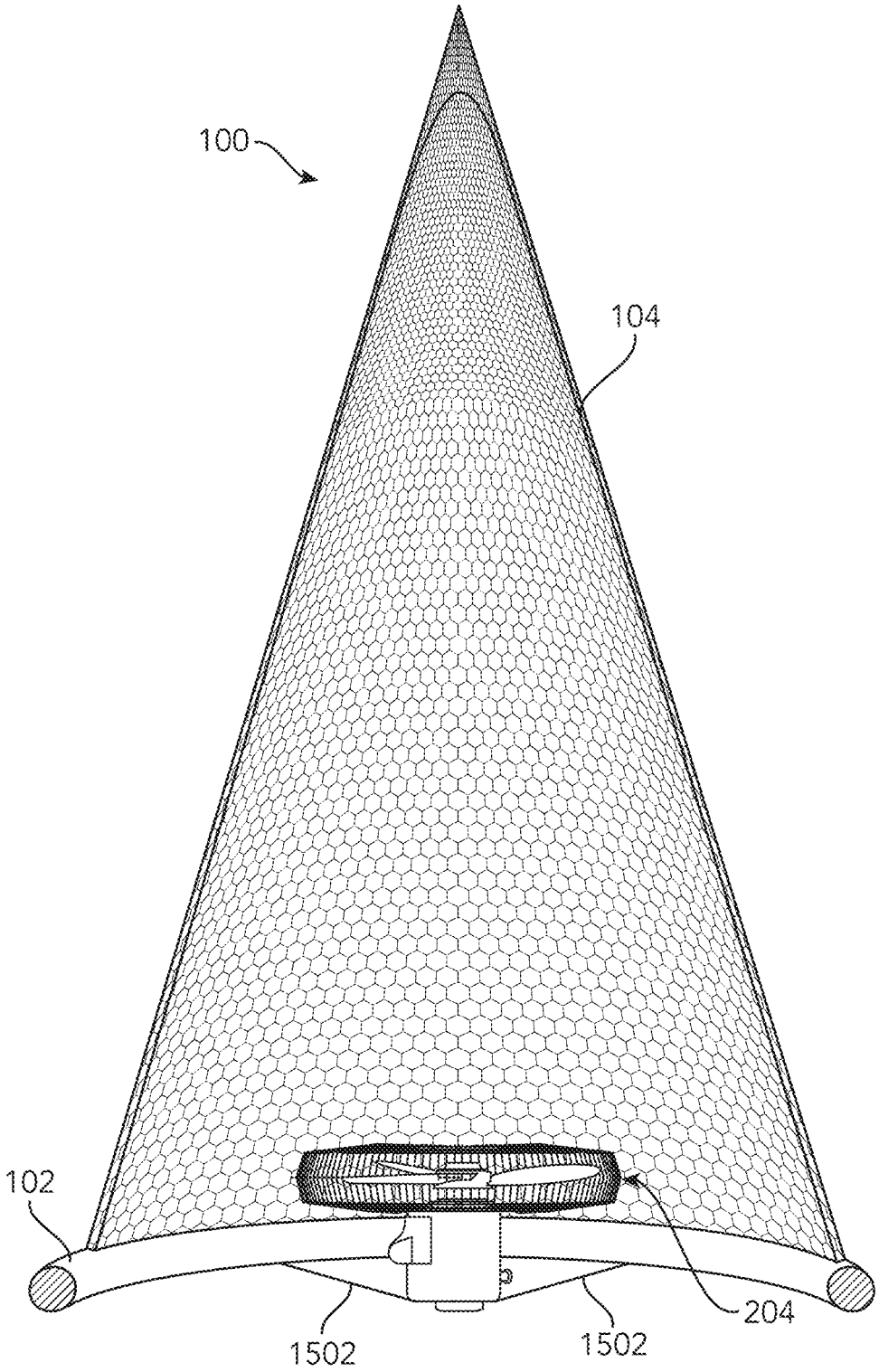
FIG. 15 illustrates a cross-sectional view of the apparatus, according to some embodiments.

FIG. 15 shows another cross-sectional view of the apparatus 100, including the air circulation device 204. In some embodiments, the air circulation device 204 is coupled to at least a portion of the structure 104, such as the base support 102, as shown in FIG. 15. The air circulation device 204 may be coupled to the base support 102, or other part of the structure 104, via at least one attachment mechanism 1502. The at least one attachment mechanism 1502 may include, but is not limited to, a bracket(s), a cord(s), a rope(s), adhesive, magnetic coupling, and/or mechanical coupling such as screw(s), bolt(s), rivet(s), and the like. The air circulation device 204 may be detachably coupled to the structure 104 such that the air circulation device 204 may be removed from the apparatus 100 for storage, in the case of bad weather, or the like. In some embodiments, the air circulation device 204 is fixedly coupled to the structure 104. Any portion or portions of the air circulation device 204 may be coupled to the structure 104.

Figure 16:
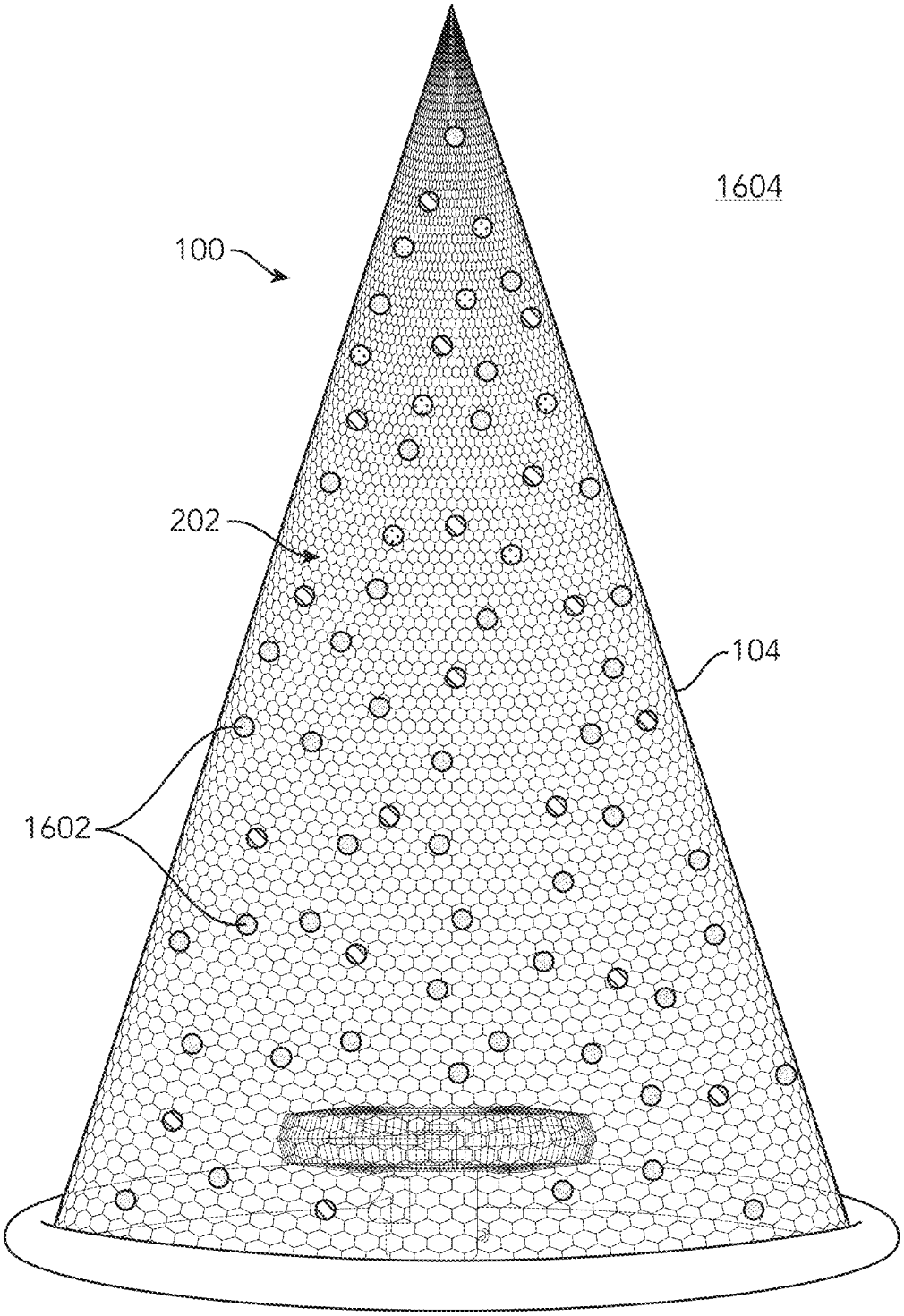
FIG. 16 illustrates a front view of the apparatus including a plurality of LEDs, according to some embodiments.

FIG. 16 illustrates the apparatus 100 with a plurality of LEDs 1602. Unlike the plurality of LEDs 902 shown in FIG. 9, the plurality of LEDs 1602 shown in FIG. 16 indicate that, in some embodiments, the plurality of LEDs 1602 is coupled to the outer surface 202 of the structure 104. In some embodiments, the plurality of LEDs 1602 includes one or more strands of LEDs similar to traditional decorative lights used around Christmas and other holidays. The plurality of LEDs 1602 may be mechanically coupled to the outer surface 202, for example, by using wire ties to secure the plurality of LEDs 1602 to the structure 104. The plurality of LEDs 1602 may be arranged in a spiral configuration around the structure 104. The plurality of LEDs 1602 may include individual lights, rather than one or more strands of connected lights. Each individual light of the plurality of LEDs 1602 may be independently coupled to the structure 104.

The plurality of LEDs 1602 may be coupled to the outer surface 202 among the plurality of ornaments 106. For example, the plurality of LEDs 1602 may be positioned between, and/or adjacent to, individual ornaments of the plurality of ornaments 106 to allow light emission between individual ornaments such that the light is visible from an external environment 1604. In some embodiments, the plurality of LEDs 1602 is positioned at least partially beneath the plurality of ornaments 106 to allow light emitted by the plurality of LEDs 1602 to reflect off the plurality of ornaments 106. The plurality of LEDs 1602 may be positioned at least partially on top of the plurality of ornaments 106. In some embodiments, the plurality of LEDs 1602 is configured to emit light in a number of patterns, including, but not limited to, the following: solid emission, flashing, blinking, fading, twinkling, motion-activated, synchronized to music, and/or the like. The plurality of LEDs 1602 may be configured to emit light in a single color or a combination of colors.

Figure 17:
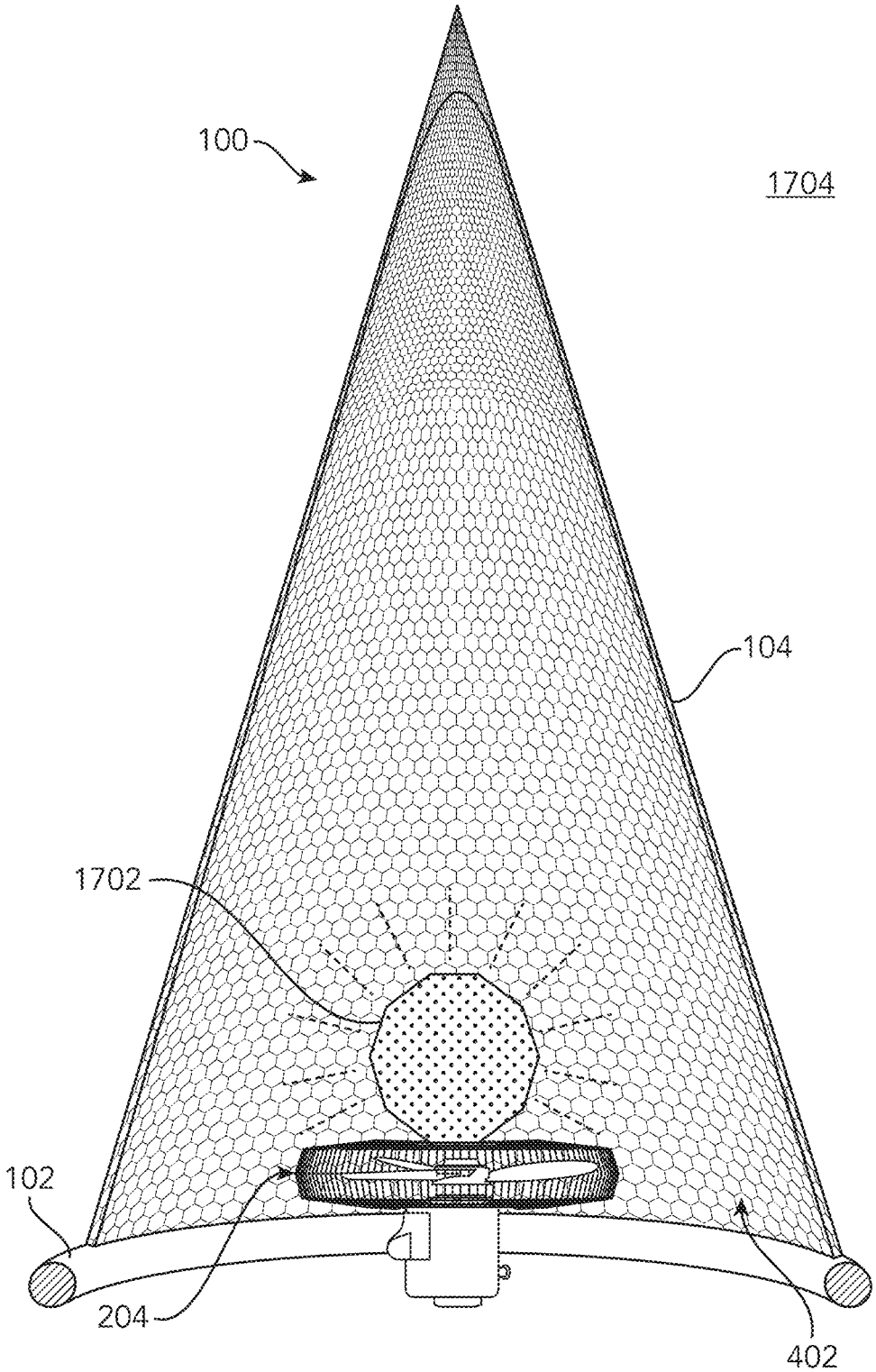
FIG. 17 illustrates a cross-sectional view of the apparatus with a light device, according to some embodiments.

FIG. 17 illustrates another cross-sectional view of the apparatus 100, including the substantially hollow interior portion 402. In some embodiments, the apparatus 100 includes a light device 1702, as shown in FIG. 17. The light device 1702 may be used instead of the plurality of LEDs 902 to emit light from the substantially hollow interior portion 402 through the structure 104 and into an external environment 1704. In some embodiments, the light device 1702 includes a housing with one or more LEDs inside the housing. The light device 1702 may be coupled to the structure 104. In some embodiments, the light device 1702 is located above the air circulation device 204, as shown in FIG. 17. The light device 1702 may be located adjacent to the air circulation device 204. In some embodiments, the light device 1702 is suspended within the substantially hollow interior portion 402. The light device 1702 may include multiple light devices 1702 located within the substantially hollow interior portion 402.

The light device 1702 may be configured to project light in several shapes and directions. For example, the light device 1702 may be configured to project light 360 degrees around the light device 1702. In some embodiments, the light device 1702 is configured to move (e.g., rotate, pivot, spin, and the like) to project light in different directions. The light device 1702 may also project light in predetermined shapes such as, but not limited to, rectangles, circles, ovals, hearts, stars, floral designs, and/or the like. In some embodiments, the light device 1702 is configured to emit light in a number of patterns, including, but not limited to, the following: solid emission, flashing, blinking, fading, twinkling, motion-activated, synchronized to music, and/or the like. The light device 1702 may be configured to emit light in a single color or a combination of colors.

It should be noted that the light device 1702 is not limited to being located within the substantially hollow interior portion 402. Instead, the light device 1702 may be located in the external environment 1704; for example, on a ground surface adjacent to the structure 104. In some embodiments, the light device 1702 is positioned a short distance (e.g., 3 feet or about 1 meter) away from the structure 104 such that the light device 1702 projects light onto the structure 104. The apparatus 100 may include multiple light devices 1702 positioned around the structure 104. In some embodiments, at least one light device 1702 is located within a separate decoration, such as a wrapped present, snowman figurine, sleigh, or the like, to disguise the light device 1702 and enhance the overall appearance of the apparatus 100 within the external environment 1704. The separate decoration may also further reflect the light emitted by the light device 1702.

FIG. 18 illustrates a cross-sectional view of an apparatus 1800. In some embodiments, the apparatus 1800 includes a base support 1802 and a conical structure 1804 extending from the base support 1802 to a pointed top end 1806. It should be noted that the apparatus 1800 may be substantially similar to the apparatus 100. As such, the base support 1802 may be substantially similar to the base support 102, the conical structure 1804 may be substantially similar to the structure 104, and the pointed top end 1806 may be substantially similar to the pointed end 304 of the structure 104.

FIG. 18 also includes an inset view of the base support 1802 and part of the conical structure 1804. In some embodiments, the base support 1802 is made of a flexible tube material 1808 configured to receive a bottom edge 1810 of the conical structure 1804. The flexible tube material 1808 may include plastic, foam, rubber, or any number of suitable materials able to flex and bend without damage. In some embodiments, the flexible tube material 1808 is configured to withstand indoor and/or outdoor conditions and may be substantially waterproof. Further, the flexible tube material 1808 may be lightweight yet sturdy enough to support the conical structure 1804 without adding an undue amount of weight to the apparatus 1800. In some embodiments, the base support 1802 includes a pool noodle or similarly-constructed element. It should be noted that the base support 1802 may be substantially solid, rather than at least partially hollow, as implied by the use of "tube" in this disclosure.

In some embodiments, the conical structure 1804 is made of a mesh material similar to the mesh material 404 of the structure 104. The conical structure 1804 may be made of poultry netting 1812, as indicated in FIG. 18. It should be noted that the mesh material 404 of the structure 104 may also be made of poultry netting, or "chicken wire." In some embodiments, the conical structure 1804 includes a double layer 1814 of poultry netting 1812. The conical structure 1804 may include a double layer 1814 for increased strength and durability. In some embodiments, each layer of the double layer 1814 is offset from the other, rather than aligned, as shown in FIG. 18. Having staggered layers of the double layer 1814 may further improve the strength of the structure 1804. In some embodiments, the conical structure 1804 uses three or more layers of poultry netting 1812. In an embodiment with three or more layers, each layer of poultry netting 1812 may be staggered or offset from another to provide increased support and strength to the structure 1804. The conical structure 1804 may use a single layer of poultry netting 1812.

Figure 19:
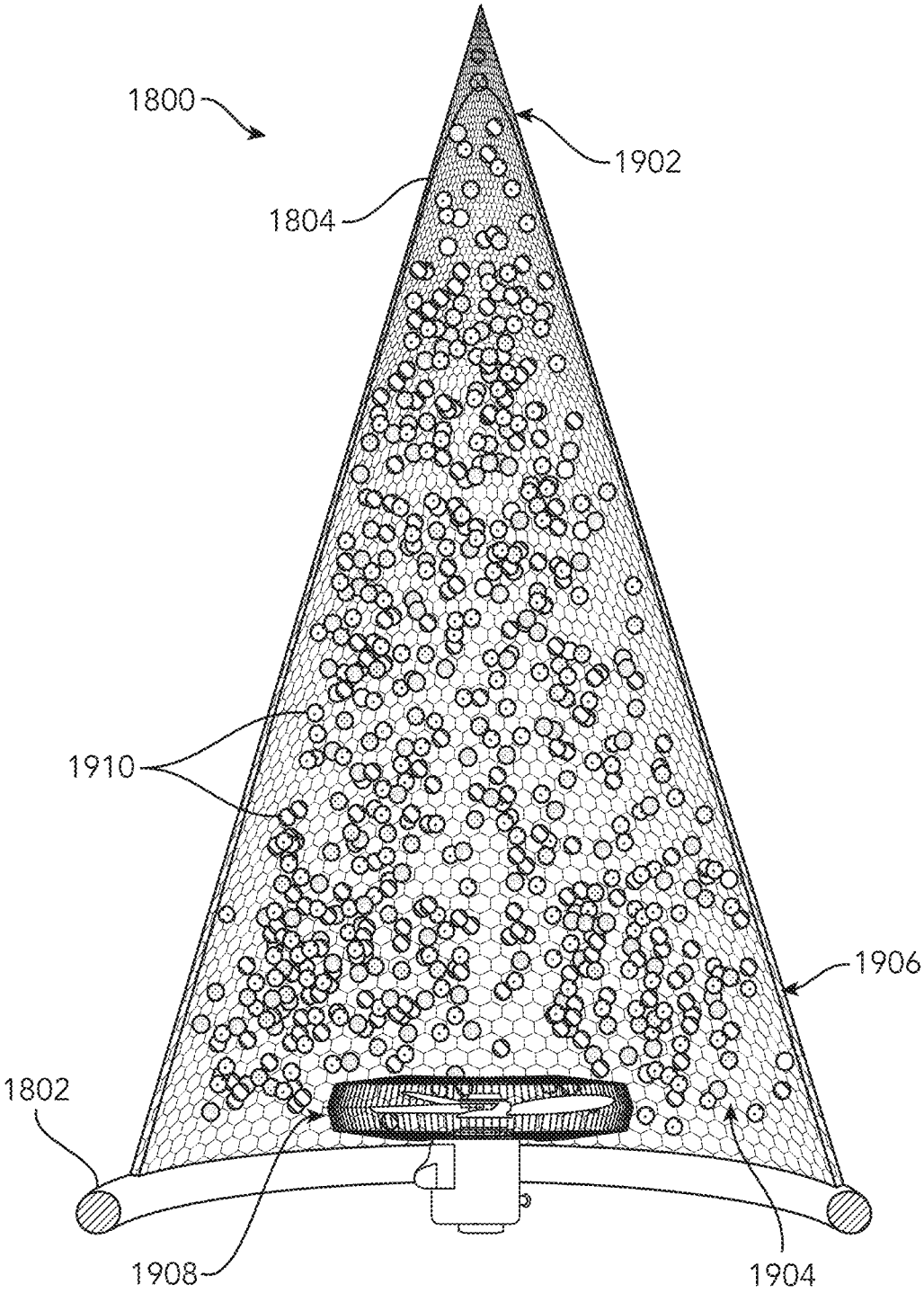
FIG. 19 illustrates a cross-sectional view of the apparatus of FIG. 18 including a plurality of LEDs, according to some embodiments.

FIG. 19 shows another cross-sectional view of the apparatus 1800 and illustrates that, in some embodiments, the conical structure 1804 includes an outer surface 1902 and a substantially hollow interior portion 1904 located opposite the outer surface 1902. The conical structure 1804 may also be configured to couple to a plurality of ornaments, such as the plurality of ornaments 106 previously discussed in this disclosure. In some embodiments, the plurality of ornaments 106 is configured to couple to the conical structure 1804 along the outer surface 1902.

Similar to the structure 104, the conical structure 1804 may be made of a mesh material 1906, as shown in FIG. 19. In some embodiments, the plurality of ornaments 106 is configured to couple to the mesh material 1906 through a plurality of openings, as discussed with reference to the plurality of openings 406 in FIGS. 4 and 5. The apparatus 1800 may include an air circulation device 1908 similar to the air circulation device 204 of the apparatus 100. In some embodiments, the air circulation device 1908 is configured to blow air through the conical structure 1804 and onto the plurality of ornaments 106.

As shown in FIG. 19, in some embodiments, the apparatus 1800 includes a plurality of LEDs 1910 coupled to the conical structure 1804. The plurality of LEDs 1910 may be coupled to the conical structure 1804 along the substantially hollow interior portion 1904. In some embodiments, the plurality of LEDs 1910 is configured to emit light from the substantially hollow interior portion 1904 through the outer surface 1902 of the conical structure 1804 and into an external environment. The plurality of LEDs 1910 may be coupled along the outer surface 1902 of the conical structure 1804, instead of along the substantially hollow interior portion 1904. In some embodiments, the plurality of LEDs 1910 is coupled along both the outer surface 1902 and the substantially hollow interior portion 1904.

When the plurality of ornaments 106 is coupled to the conical structure 1804, the light emitted by the plurality of LEDs 1910 may also be configured to reflect off the plurality of ornaments 106. For example, when the fringe 702 of FIG. 7 is coupled to the conical structure 1804, the light emitted by the plurality of LEDs 1910 may cause the fringe 702 to shimmer, especially when combined with airflow from the air circulation device 1908. The airflow from the air circulation device 1908 may also cause movement of the plurality of LEDs 1910, and further impact the appearance of the apparatus 1800. In some embodiments, the plurality of LEDs 1910 is configured to emit light in a number of patterns, including, but not limited to, the following: solid emission, flashing, blinking, fading, twinkling, motion-activated, synchronized to music, and/or the like. The plurality of LEDs 1910 may be configured to emit light in a single color or a combination of colors.

Figure 20:
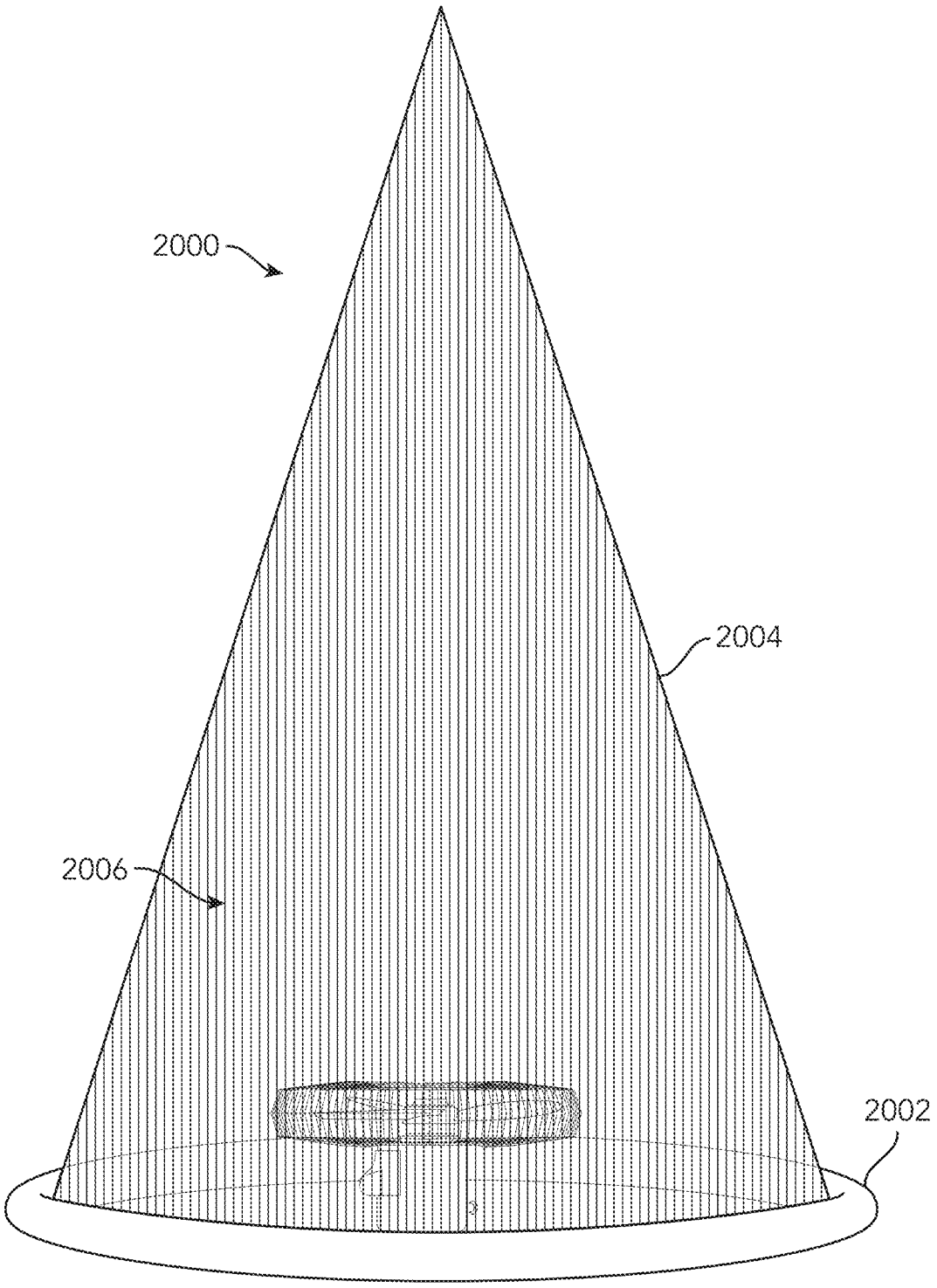
FIG. 20 illustrates a front view of an apparatus made of substantially solid material, according to some embodiments.

FIG. 20 shows an apparatus 2000. In some embodiments, the apparatus 2000 includes a base support 2002 and a structure 2004 extending from, and stabilized by, the base support 2002. The base support 2002 may be substantially similar to the base support 102 and the base support 1802. In some embodiments, the structure 2004 defines a similar conical shape as the structure 104 and the conical structure 1804.

Rather than being constructed of a mesh material like the structure 104 and the conical structure 1804, the structure 2004 may be made of a substantially solid material 2006. In some embodiments, the substantially solid material 2006 is at least partially transparent. For example, if a light source, such as the plurality of LEDs 902 or the light device 1702, were placed within the structure 2004, the light emitted may be visible through the substantially solid material 2006. In some embodiments, the substantially solid material 2006 is a non-opaque plastic material. The substantially solid material 2006 may be a reflective material such that a light source positioned around an exterior of the structure 2004 would reflect light off of the substantially solid material 2006. The substantially solid material 2006 may be lightweight to enable easy movement of the apparatus 2000.

In some embodiments, the substantially solid material 2006 includes small perforations to enable a plurality of ornaments, such as the plurality of ornaments 106, to be coupled to the structure 2004. The plurality of ornaments 106 may be coupled to the structure 2004 via other means, such as adhesive. In some embodiments, the substantially solid material 2006 includes a few larger openings positioned around the structure 2004 to enable the coupling of fewer, though potentially larger ornaments. The apparatus 2000 may also include an air circulation device, like the air circulation device 204, positioned within the structure 2004. In some embodiments, the air circulation device within the structure 2004 is configured to move air through any perforations and/or openings in the substantially solid material 2006, and onto any ornaments coupled to the structure 2004. In some embodiments, the air circulation device is located external to the structure 2004.

Figure 21:
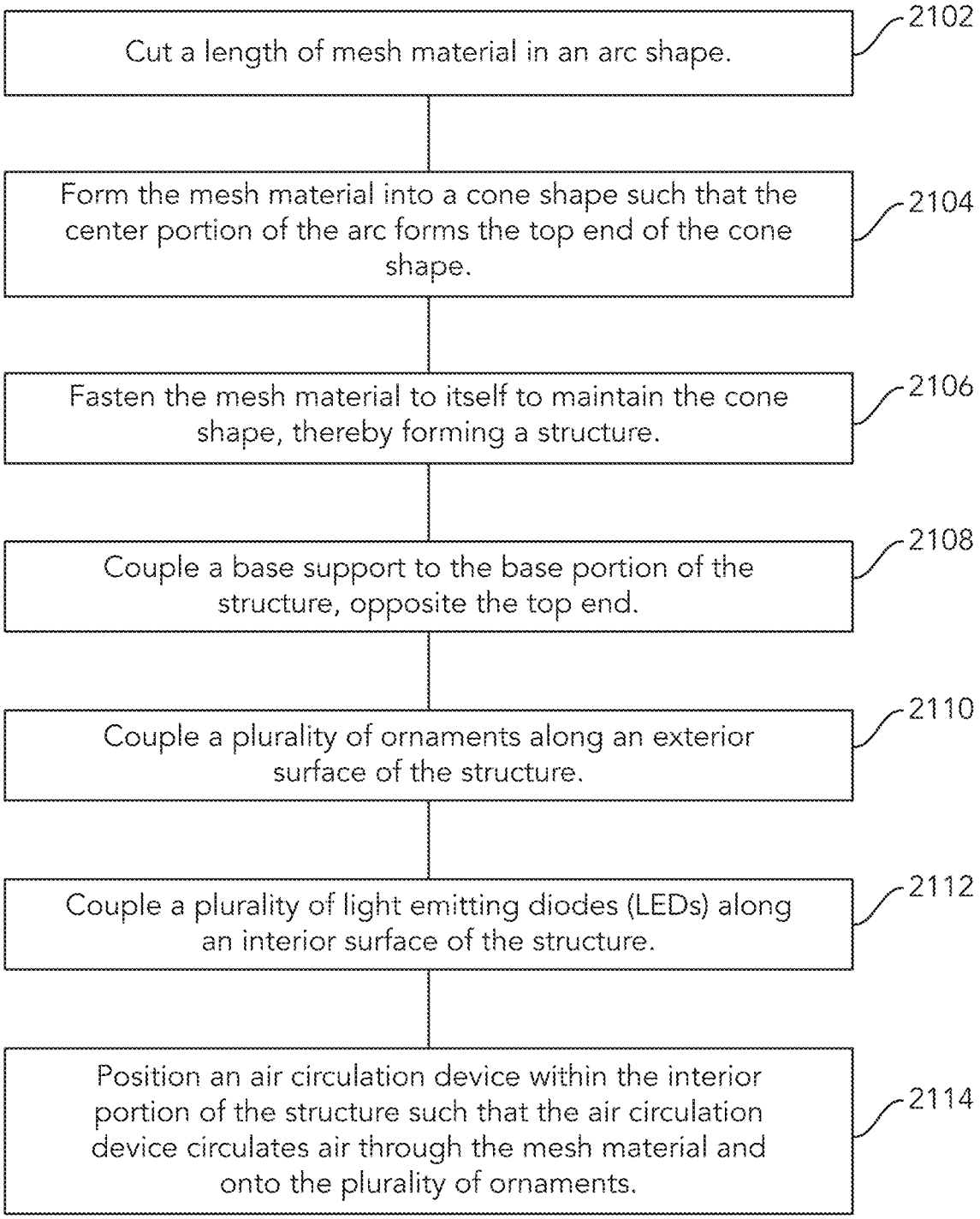
FIG. 21 illustrates a flow chart of assembling the apparatus, according to some embodiments.

FIG. 21 illustrates a flowchart demonstrating how to assemble the apparatus 100. The flowchart may also be applicable for assembling the apparatus 1800. In some embodiments, assembly begins with cutting a length of mesh material in an arc shape, at Step 2102. Then, form the mesh material into a cone shape such that the center portion of the arc forms the top end of the cone shape, at Step 2104. Assembly may continue with fastening the mesh material to itself to maintain the cone shape, thereby forming a structure, at Step 2106. In some embodiments, the next step is to couple a base support to the base portion of the structure, opposite the top end, at Step 2108. Then, couple a plurality of ornaments along an exterior surface of the structure, at Step 2110. In some embodiments, assembly includes coupling a plurality of light emitting diodes (LEDs) along an interior surface of the structure, at Step 2112. Finally, position an air circulation device within the interior portion of the structure such that the air circulation device circulates air through the mesh material and onto the plurality of ornaments, at Step 2114.

In some embodiments, the base support of Step 2108 is a flexible tube material, and coupling the base support to the base portion of the structure includes slicing the base support to create an opening along substantially an entire length of the base support. The opening may extend into an interior portion of the flexible tube material (for example). In some embodiments Step 2108 further includes positioning the base portion of the structure in the opening such that the base support receives the base portion of the structure within the interior portion of the base support (e.g., flexible tube material).

It should be noted that any one or more of the apparatus 100, the apparatus 1800, and the apparatus 2000 may include means to remotely control any powered component of each apparatus 100, 1800, 2000. For example, the apparatus 100 may include a control panel, a timer, a remote control, an application on a smartphone or tablet, and/or the like, to operate the air circulation device 204, the plurality of LEDs 902, the plurality of LEDs 1602, and/or the light device 1702. The apparatus 1800 may include a control panel, a timer, a remote control, an application on a smartphone or tablet, and/or the like, to operate the air circulation device 1908 and/or the plurality of LEDs 1910. The apparatus 2000 may include a control panel, a timer, a remote control, an application on a smartphone or tablet, and/or the like, to operate an air circulation device and/or a plurality of LEDs. Elements other than air circulation device(s) and/or lights may be operable by a remote device.

Example Dimensions and Materials

The dimensions and materials provided herein are intended as nonlimiting examples for the apparatus 100 and the apparatus 1800.

- Two (2) rolls of 4-feet×50-feet, 20-gauge galvanized steel poultry netting
- Two (2) 4-feet long, 3-inch diameter foam pool noodles
- Three (3) 20-feet rolls of LED lights
- 4-inch tie wires
- One (1) 20-inch industrial indoor/outdoor floor fan
- Ornaments: 16-feet long, 6-inch metallic foil tassel fringe, one hundred (100) reflective aluminum pinwheels, 6-inch diameter maximum, or other ornaments of choice In some embodiments, the apparatus 100, 1800 is made of two rolls of poultry netting with the edges overlapped about ten inches and tied to each other at random areas by tie wire. The poultry netting may be about 14 feet wide and about 6 feet, 10 inches tall before being cut into an arc and shaped into a cone, as referenced in FIG. 21. The finished apparatus 100, 1800 may be about seven feet tall with a base about four feet in diameter. In some embodiments, the finished apparatus 100, 1800 is between about six and seven feet tall and has a diameter at the base portion between about three and four feet. For example, the apparatus 100, 1800 may be 6 feet, 8 inches tall and may have a diameter at the base portion of about 3 feet, 9 inches.

Some of the components listed herein use the same number from figure to figure. It should be appreciated these components use the same numbers solely for ease of reference and to facilitate comprehension for the reader. While these components may use the same numbers, differences may be present in these components as illustrated in the various figures in which they appear and as described in the specification herein.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy.

The term "adjacent" is used to mean "next to" to "adjoining." For example, the disclosure includes, "The light device 1702 may be located adjacent to the air circulation device 204." In this context, "adjacent to the air circulation device" means that the light device may be next to or adjoining the air circulation device.

The term "substantially" is used to mean "completely" or "nearly completely." For example, the disclosure includes, " . . . wherein the structure includes a substantially hollow interior portion . . . " In this context, a "substantially hollow interior portion" means that the interior portion is completely or nearly completely hollow. However, the interior portion does not have to be perfectly hollow to fall into the understanding of "substantially hollow" as defined in this disclosure.

The foregoing may be accomplished through software code running in one or more processors on a communication device in conjunction with a processor in a server running complementary software code.

Some of the devices, systems, embodiments, and processes use computers. Each of the routines, processes, methods, and algorithms described in the preceding sections may be embodied in, and fully or partially automated by, code modules executed by one or more computers, computer processors, or machines configured to execute computer instructions. The code modules may be stored on any type of non-transitory computer-readable storage medium or tangible computer storage device, such as hard drives, solid state memory, flash memory, optical disc, and/or the like. The processes and algorithms may be implemented partially or wholly in application-specific circuitry. The results of the disclosed processes and process steps may be stored, persistently or otherwise, in any type of non-transitory computer storage such as, e.g., volatile or non-volatile storage.

It is appreciated that in order to practice the method of the foregoing as described above, it is not necessary that the processors and/or the memories of the processing machine be physically located in the same geographical place. That is, each of the processors and the memory (or memories) used by the processing machine may be located in geographically distinct locations and connected so as to communicate in any suitable manner. Additionally, it is appreciated that each of the processor and/or the memory may be composed of different physical pieces of equipment. Accordingly, it is not necessary that the processor be one single piece of equipment in one location and that the memory be another single piece of equipment in another location. That is, it is contemplated that the processor may be two pieces of equipment in two different physical locations. The two distinct pieces of equipment may be connected in any suitable manner. Additionally, the memory may include two or more portions of memory in two or more physical locations.

To explain further, processing, as described above, is performed by various components and various memories. However, it is appreciated that the processing performed by two distinct components as described above may, in accordance with a further embodiment of the foregoing, be performed by a single component. Further, the processing performed by one distinct component as described above may be performed by two distinct components. In a similar manner, the memory storage performed by two distinct memory portions, as described above, may, in accordance with a further embodiment of the foregoing, be performed by a single memory portion. Further, the memory storage, performed by one distinct memory portion, as described above, may be performed by two memory portions.

Further, various technologies may be used to provide communication between the various processors and/or memories, as well as to allow the processors and/or the memories of the foregoing to communicate with any other entity, i.e., so as to obtain further instructions or to access and use remote memory stores, for example. Such technologies used to provide such communication might include a network, the Internet, Intranet, Extranet, LAN, an Ethernet, wireless communication via cell tower or satellite, or any client server system that provides communication, for example. Such communications technologies may use any suitable protocol such as TCP/IP, UDP, or OSI, for example.

As described above, a set of instructions may be used in the processing of the foregoing. The set of instructions may be in the form of a program or software. The software may be in the form of system software or application software, for example. The software might also be in the form of a collection of separate programs, a program module within a larger program, or a portion of a program module, for example. The software used might also include modular programming in the form of object-oriented programming. The software may instruct the processing machine what to do with the data being processed.

Further, it is appreciated that the instructions or set of instructions used in the implementation and operation of the foregoing may be in a suitable form such that the processing machine may read the instructions. For example, the instructions that form a program may be in the form of a suitable programming language, which is converted to machine language or object code to allow the processor or processors to read the instructions. That is, written lines of programming code or source code, in a particular programming language, are converted to machine language using a compiler, assembler or interpreter. The machine language is binary coded machine instructions that are specific to a particular type of processing machine, i.e., to a particular type of computer, for example. The computer understands the machine language.

Any suitable programming language may be used in accordance with the various embodiments of the foregoing. Illustratively, the programming language used may include assembly language, Ada, APL, Basic, C, C++, COBOL, dBase, Forth, Fortran, Java, Modula-2, Pascal, Prolog, Python, REXX, Visual Basic, and/or JavaScript, for example. Further, it is not necessary that a single type of instruction or single programming language be utilized in conjunction with the operation of the system and method of the foregoing. Rather, any number of different programming languages may be utilized as is necessary and/or desirable.

Also, the instructions and/or data used in the practice of the foregoing may utilize any compression or encryption technique or algorithm, as may be desired. An encryption module might be used to encrypt data. Further, files or other data may be decrypted using a suitable decryption module, for example.

As described above, the foregoing may illustratively be embodied in the form of a processing machine, including a computer or computer system, for example, that includes at least one memory. It is to be appreciated that the set of instructions, i.e., the software for example, that enables the computer operating system to perform the operations described above may be contained on any of a wide variety of media or medium, as desired. Further, the data that is processed by the set of instructions might also be contained on any of a wide variety of media or medium. That is, the particular medium, i.e., the memory in the processing machine, utilized to hold the set of instructions and/or the data used in the foregoing may take on any of a variety of physical forms or transmissions, for example. Illustratively, the medium may be in the form of paper, paper transparencies, a compact disk, a DVD, an integrated circuit, a hard disk, a floppy disk, an optical disk, a magnetic tape, a RAM, a ROM, a PROM, an EPROM, a wire, a cable, a fiber, a communications channel, a satellite transmission, a memory card, a SIM card, or other remote transmission, as well as any other medium or source of data that may be read by the processors of the foregoing.

Further, the memory or memories used in the processing machine that implements the foregoing may be in any of a wide variety of forms to allow the memory to hold instructions, data, or other information, as is desired. Thus, the memory might be in the form of a database to hold data. The database might use any desired arrangement of files such as a flat file arrangement or a relational database arrangement, for example.

In the system and method of the foregoing, a variety of "user interfaces" may be utilized to allow a user to interface with the processing machine or machines that are used to implement the foregoing. As used herein, a user interface includes any hardware, software, or combination of hardware and software used by the processing machine that allows a user to interact with the processing machine. A user interface may be in the form of a dialogue screen for example. A user interface may also include any of a mouse, touch screen, keyboard, keypad, voice reader, voice recognizer, dialogue screen, menu box, list, checkbox, toggle switch, a pushbutton or any other device that allows a user to receive information regarding the operation of the processing machine as it processes a set of instructions and/or provides the processing machine with information. Accordingly, the user interface is any device that provides communication between a user and a processing machine. The information provided by the user to the processing machine through the user interface may be in the form of a command, a selection of data, or some other input, for example.

As discussed above, a user interface is utilized by the processing machine that performs a set of instructions such that the processing machine processes data for a user. The user interface is typically used by the processing machine for interacting with a user either to convey information or receive information from the user. However, it should be appreciated that in accordance with some embodiments of the system and method of the foregoing, it is not necessary that a human user actually interact with a user interface used by the processing machine of the foregoing. Rather, it is also contemplated that the user interface of the foregoing might interact, i.e., convey and receive information, with another processing machine, rather than a human user. Accordingly, the other processing machine might be characterized as a user. Further, it is contemplated that a user interface utilized in the system and method of the foregoing may interact partially with another processing machine or processing machines, while also interacting partially with a human user.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable.

Indeed, the novel methods and systems described herein may be embodied in a variety of other forms; furthermore, various omissions, substitutions, and changes in the form of the methods and systems described herein may be made without departing from the spirit of the inventions disclosed herein.

I claim:

1. An apparatus, comprising:

a base support;

a top end located opposite the base support;

a structure extending from the base support, the structure further comprising a substantially hollow interior portion and an outer lateral surface located opposite the substantially hollow interior portion, the outer lateral surface extending between the base support and the top end;

a plurality of ornaments located on the outer lateral surface of the structure; and an air circulation device located within the substantially hollow interior portion of the structure, wherein the air circulation device is configured to circulate air through the outer lateral surface of the structure and onto the plurality of ornaments, thereby moving the plurality of ornaments.

2. The apparatus of claim 1, wherein the plurality of ornaments is selected from the group consisting of a plurality of pinwheels, a plurality of baubles, fringe, and combinations thereof.

3. The apparatus of claim 1, wherein the structure defines a substantially conical shape.

4. The apparatus of claim 1, wherein the base support defines a substantially circular shape, and the top end portion defines a pointed end.

5. The apparatus of claim 1, wherein the structure comprises a plurality of openings in the outer lateral surface.

6. The apparatus of claim 5, wherein at least one ornament of the plurality of ornaments comprises a fastening element configured to couple to an opening of the plurality of openings such that the fastening element at least partially extends through the outer lateral surface of the structure into the substantially hollow interior portion.

7. The apparatus of claim 6, wherein at least a portion of at least one ornament of the plurality of ornaments is located along an inner surface of the structure.

8. The apparatus of claim 5, wherein each opening of the plurality of openings is configured to facilitate circulation of air between the substantially hollow interior portion and the outer lateral surface.

9. The apparatus of claim 1, wherein the structure is comprised of a mesh material comprising a plurality of interlaced wires.

10. The apparatus of claim 9, wherein the structure comprises a double layer of mesh material.

11. The apparatus of claim 9, wherein the mesh material comprises poultry netting.

12. The apparatus of claim 1, further comprising a plurality of light emitting diodes (LEDs) configured to couple to the structure.

13. The apparatus of claim 12, wherein the plurality of LEDs is coupled to the structure along the substantially hollow interior portion.

14. The apparatus of claim 13, wherein the plurality of LEDs is configured to emit light from the substantially hollow interior portion through the outer lateral surface of the structure and into an external environment.

15. The apparatus of claim 1, further comprising an upper accessory configured to couple to the top end portion of the structure.

16. An apparatus, comprising:

a base support;

a conical structure extending from the base support to a pointed top end, the conical structure further comprising a substantially hollow interior portion and an outer lateral surface located opposite the substantially hollow interior portion, wherein the conical structure is comprised of a mesh material comprising a plurality of openings extending between the substantially hollow interior portion and the outer lateral surface of the conical structure;

at least one ornament located on the outer lateral surface of the conical structure and coupled to the mesh material; and an air circulation device located within the substantially hollow interior portion of the conical structure, the air circulation device configured to circulate air through the plurality of openings and onto the at least one ornament, thereby moving the at least one ornament.

17. The apparatus of claim 16, wherein the base support comprises a flexible tube material configured to receive a bottom edge of the conical structure, wherein the bottom edge is located opposite the pointed top end.

18. The apparatus of claim 16, further comprising a plurality of light emitting diodes (LEDs) coupled to the conical structure along at least one of the substantially hollow interior portion and the outer lateral surface.

19. The apparatus of claim 18, wherein the plurality of LEDs is coupled to the conical structure along the substantially hollow interior portion, and the at least one ornament is coupled to the conical structure along the outer lateral surface.

20. The apparatus of claim 16, wherein the air circulation device comprises a first air circulation device, the apparatus further comprising at least one additional air circulation device.

* * * * *